US010450726B2

(12) United States Patent
Nishikawa et al.

(10) Patent No.: US 10,450,726 B2
(45) Date of Patent: Oct. 22, 2019

(54) PUMP CONTROL SYSTEM OF WORK MACHINE

(71) Applicant: Hitachi Construction Machinery Co., Ltd., Taito-ku, Tokyo (JP)

(72) Inventors: Shinji Nishikawa, Kasumigaura (JP); Shinya Imura, Toride (JP); Hidekazu Moriki, Mito (JP); Hiroaki Amano, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 31 days.

(21) Appl. No.: 15/755,773

(22) PCT Filed: Sep. 28, 2016

(86) PCT No.: PCT/JP2016/078716
§ 371 (c)(1),
(2) Date: Feb. 27, 2018

(87) PCT Pub. No.: WO2018/061128
PCT Pub. Date: Apr. 5, 2018

(65) Prior Publication Data

US 2019/0112786 A1 Apr. 18, 2019

(51) Int. Cl.
*E02F 9/22* (2006.01)
*F04B 49/06* (2006.01)
(Continued)

(52) U.S. Cl.
CPC ..... *E02F 9/2232* (2013.01); *E02F 9/22* (2013.01); *E02F 9/2267* (2013.01); *F04B 49/06* (2013.01);
(Continued)

(58) Field of Classification Search
CPC ..... E02F 9/2217; E02F 9/2292; E02F 9/2239; E02F 9/2232; F15B 11/028; F15B 21/087
See application file for complete search history.

(56) References Cited

U.S. PATENT DOCUMENTS 5,930,996 A * 8/1999 Nakamura ..... E02F 9/2235 60/426
8,347,619 B2 * 1/2013 Kim ..... E02F 9/2066 417/216
(Continued)

FOREIGN PATENT DOCUMENTS

JP 2005-265002 A 9/2005
JP 2011-157790 A 8/2011
(Continued)

OTHER PUBLICATIONS

English translation of document C1 (Japanese-language Search Report (PCT/ISA/210) issued in PCT Application No. PCT/JP2016/078716 previously filed on Feb. 27, 2018 (one (1) page).
(Continued)

*Primary Examiner* — Abiy Teka
(74) *Attorney, Agent, or Firm* — Crowell & Moring LLP

(57) ABSTRACT

A work machine pump control system includes: a pump horsepower control valve (22) which causes a first urging force determining a limited horsepower (F) of a hydraulic pump and a second urging force due to a delivery pressure of the hydraulic pump to act on a spool in opposition to each other and which controls the pump flow rate such that it does not exceed the limited horsepower (F); a target pump flow rate computation section (42) computing a target pump flow rate based on an operation pressure (px) and a load pressure (py); a target horsepower computation section (41) which computes a required horsepower (Freq) corresponding to an operation pressure (px) from a relationship related to the operation pressure (px) and which computes a target horse-
(Continued)

power (Ftar) based on the required horsepower (Freq); and a pump horsepower control section (35) which controls the pump horsepower control valve (22) such that the target pump flow rate (Qtar) is delivered with the limited horsepower (F) determined by the pump horsepower control valve (22).

6 Claims, 17 Drawing Sheets

(51) Int. Cl.
*F15B 11/028* (2006.01)
*F15B 11/08* (2006.01)
*F15B 21/08* (2006.01)

(52) U.S. Cl.
CPC ..... *F15B 11/028* (2013.01); *F15B 11/08* (2013.01); *F15B 21/087* (2013.01); *F15B 2211/20523* (2013.01); *F15B 2211/20553* (2013.01); *F15B 2211/30535* (2013.01); *F15B 2211/327* (2013.01); *F15B 2211/329* (2013.01); *F15B 2211/6054* (2013.01); *F15B 2211/6309* (2013.01); *F15B 2211/6313* (2013.01); *F15B 2211/6316* (2013.01); *F15B 2211/6355* (2013.01); *F15B 2211/6652* (2013.01); *F15B 2211/6654* (2013.01); *F15B 2211/6655* (2013.01)

(56) References Cited

U.S. PATENT DOCUMENTS

| | | | | |
|---|---|---|---|---|
| 8,701,401 | B2 * | 4/2014 | Ooi | E02F 9/2246 60/431 |
| 9,181,684 | B2 * | 11/2015 | Okano | E02F 9/2282 |
| 2005/0204735 | A1 | 9/2005 | Sugano | |
| 2010/0303642 | A1 * | 12/2010 | Nanjo | E02F 9/2235 417/212 |
| 2012/0285157 | A1 | 11/2012 | Okano et al. | |

FOREIGN PATENT DOCUMENTS

| | | | |
|---|---|---|---|
| JP | 2014-190516 | A | 10/2014 |
| KR | 10-2014-0100981 | A | 8/2014 |

OTHER PUBLICATIONS

Japanese-language International Search Report (PCT/ISA/210) issued in PCT Application No. PCT/JP2016/078716 dated Dec. 20, 2016 (Three (3) pages).

Japanese-language Written Opinion (PCT/ISA/237) issued in PCT Application No. PCT/JP2016/078716 dated Dec. 20, 2016 (Four (4) pages).

International Preliminary Report on Patentability (PCT/IB/338 & PCT/IB/373) issued in PCT Application No. PCT/JP2016/078716 dated Apr. 11, 2019, including English translation of document C2 (Japanese-language Written Opinion (PCT/ISA/237) previously filed on Feb. 27, 2018) (seven (7) pages).

* cited by examiner

PUMP CONTROL SYSTEM OF WORK MACHINE

TECHNICAL FIELD

The present invention relates to a pump control system of a work machine such as a hydraulic excavator and, in particular, to a pump control system of a work machine performing flow rate control (capacity control) on a bent axis type hydraulic pump.

BACKGROUND ART

There is a work machine such as a hydraulic excavator which adopts a pump flow rate controller controlling the pump flow rate in a positive fashion through the control of a regulator (pump flow rate control valve) in accordance with the operation of an operation device. A pump flow rate controller of this type includes, apart from one which directly controls a pump flow rate control valve with the operation pressure of a pilot operation type operation device, one which determines a target pump flow rate by a controller on the basis of the operation pressure to control the pump flow rate control valve (See Patent Document 1, or the like).

PRIOR ART DOCUMENT

Patent Document

Patent Document 1: JP-2014-190516-A

SUMMARY OF THE INVENTION

Problem to be Solved by the Invention

In the case where a pump flow rate control valve is directly controlled by an operation pressure, the hydraulic characteristic of the operation device is strongly reflected in the pump flow rate control characteristic, whereas, in the case where the pump flow rate control valve is controlled by using a controller, it is advantageously possible to achieve a flow rate control characteristic different from the characteristic of the operation device. Further, when computing the target pump flow rate by the controller, by adding the pump pressure to basic information, it is possible to compute the target pump flow rate restricted by the target horsepower. In this case, it is possible to clearly control the pump flow rate with respect to the pump pressure and to achieve an improvement in terms of horsepower control accuracy.

An example of the variable displacement type hydraulic pump is a bent axis type hydraulic pump, which is regarded to be of higher efficiency as compared with a variable displacement type hydraulic pump of some other type such as the swash plate type. On the other hand, as compared with a hydraulic pump of some other type which is approximately of the same capacity, the variable displacement mechanism including a cylinder block is heavy, and the capacity change response with respect to the change in the operation amount tends to be rather delayed. Thus, in the case where the pump flow rate control valve is controlled by the controller with the bent axis type hydraulic pump being the object of control, there is likely to be generated, in some cases, pressure hunting due to the delay in the response operation with respect to the controller command. When pressure hunting is generated, there can be generated deterioration in operability due to fluctuations in acceleration in the actuator operation, and deterioration in fuel efficiency due to an excessive torque of the hydraulic pump and the engine.

It is an object of the present invention to provide a work machine pump control system which helps to achieve an improvement in terms of responsiveness in the pump flow rate control with respect to the controller command and which can suppress pressure hunting in the bent axis type hydraulic pump.

Means for Solving the Problem

To achieve the above object, there is provided, in accordance with the present invention, a work machine pump control system equipped with: at least one actuator driving a driven member; a hydraulic pump that is a variable displacement type and of a bent axis type and that delivers a hydraulic fluid for driving the actuators; at least one control valve controlling the hydraulic fluid to be supplied to a corresponding actuator from the hydraulic pump; at least one pilot operation type operation device generating an operation pressure in accordance with an operation and outputting the operation pressure thus generated to a corresponding control valve; a pilot pump generating an initial pressure of the operation pressure; at least one operation pressure sensor detecting an operation pressure of a corresponding operation device; and at least one load pressure sensor detecting the pressure of a line connecting the hydraulic pump and the actuator as a load pressure. The work machine pump control system includes: a pump horsepower control valve that causes a first urging force determining a limited horsepower of the hydraulic pump and a second urging force due to a delivery pressure of the hydraulic pump to act on a spool in opposition to each other and which controls capacity of the hydraulic pump such that a pump absorption horsepower does not exceed the limited horsepower; a target pump flow rate computation section computing a target pump flow rate of the hydraulic pump, based on an operation pressure detected by the at least one operation pressure sensor and on a load pressure detected by the load pressure sensor; a target horsepower computation section which computes a required horsepower corresponding to the detected operation pressure from a relationship related to the operation pressure of a corresponding operation device and which computes a target horsepower based on the required horsepower; and a pump horsepower control section which controls the pump horsepower control valve, based on a target pump flow rate computed by the target pump flow rate computation section and on a target horsepower computed by the target horsepower computation section, such that the target pump flow rate is delivered with the limited horsepower determined by the pump horsepower control valve.

Advantage of the Invention

According to the present invention, it is possible to achieve an improvement in terms of the responsiveness of the pump flow rate control with respect to the controller command, and to suppress the pressure hunting of the bent axis type hydraulic pump.

MODES FOR CARRYING OUT THE INVENTION

In the following, embodiments of the present invention will be described with reference to the drawings.

[First Embodiment]

(1-1) Work Machine

Figure 1:
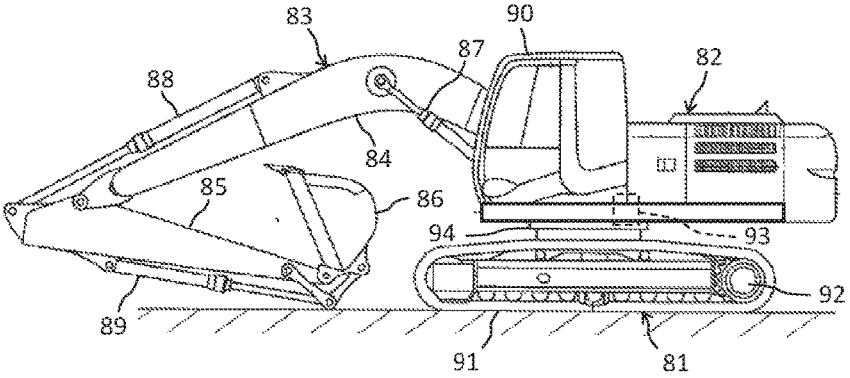
FIG. 1 is an external perspective view of a hydraulic excavator which is an example of a work machine to which a pump control system according to the present invention is applied.

FIG. 1 is an external perspective view of a hydraulic excavator which is an example of a work machine to which a pump control system according to the present invention is applied. In the following, unless otherwise specified, the front side of the driver's seat (the left-hand side in the diagram) means the front side of the machine body. It should be noted, however, that the object of application of the pump control system according to the present invention is not restricted to a hydraulic excavator. The pump control system according to embodiments is also applicable to other kinds of work machine such as a crane, a bulldozer, and a wheel loader.

The hydraulic excavator shown in the diagram is equipped with a track structure 81, a swing structure 82 provided on the track structure 81, and a work device (front work device) 83 mounted to the swing structure 82. The track structure 81 is of a crawler type which travels by means of right and left crawler belts 91. The swing structure 82 is provided on top of the track structure 81 via a swing ring 94, and is equipped with a cab 90. In the cab 90, there are arranged a seat (not shown) on which the operator is seated, and an operation device (an operation device 11, or the like of FIG. 2) operated by the operator. The work device 83 is equipped with a boom 84 rotatably mounted to the front portion of the track structure 82, an arm 85 rotatably mounted to the distal end of the boom 84, and a bucket 86 rotatably mounted to the distal end of the arm 85.

Further, the hydraulic excavator is equipped with right and left traveling motors 92, a swinging motor 93, a boom cylinder 87, an arm cylinder 88, and a bucket cylinder 89 as actuators (hydraulic actuators). The right and left traveling motors 92 drive the right and left crawler belts 91 of the track structure 81. The swinging motor 93 drives a swing ring 94 to swing the swing structure 82 with respect the track structure 81. The boom cylinder 87 drives the boom 84 vertically. The arm cylinder 88 drives the arm 85 to the damping side (opening side) and the crowding side (sweeping-in side). The bucket cylinder 89 drives the bucket 86 to the damping side and the crowding side. That is, in addition to the above-mentioned crawler belts 91 and the swing ring 94, the boom 84, the arm 85, and the bucket 86 correspond to the driven members driven by the hydraulic actuators.

(1-2) Hydraulic System

Figure 2:
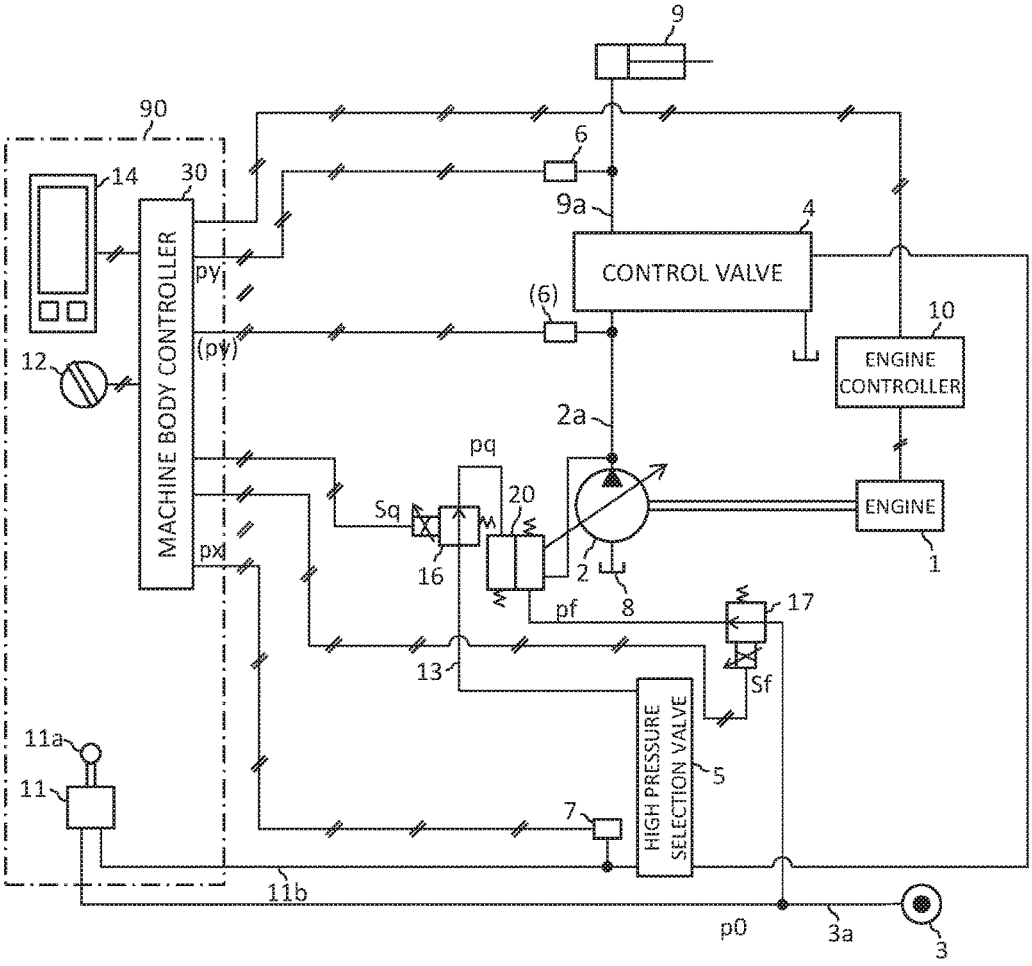
FIG. 2 is a circuit diagram illustrating a main portion of a hydraulic system including a pump control system according to a first embodiment of the present invention.

FIG. 2 is a circuit diagram illustrating a main portion of a hydraulic system including a pump control system according to a first embodiment of the present invention. While the diagram solely shows a circuit related to the operation in one direction of a specific hydraulic actuator 9, there actually also exists a circuit related to the operation in the other direction (e.g., boom lowering operation) (See FIG. 3). Further, while the drawing shows solely one hydraulic pump 2 and one hydraulic actuator 9, in some cases, a circuit construction may be adopted in which a plurality of hydraulic actuators 9 are driven by one hydraulic pump 2. In the case of the present embodiment, the hydraulic actuator 9 is at least one of the boom cylinder 87, the arm cylinder 88, the bucket cylinder 89, the traveling motor 92, and the swinging motor 93 (e.g., the boom cylinder 87). Assuming that the hydraulic actuator 9 is the boom cylinder 87, the one-way operation mentioned above is, for example, the boom raising operation.

The hydraulic system shown in FIG. 2 is equipped with a hydraulic pump 2, a pilot pump 3, an operation device 11, a control valve 4, a high pressure selection valve 5, a load pressure sensor 6, an operation pressure sensor 7, a display device 14, and a pump control system. In the following, the elements will be described one by one.

(1-2. 1) Hydraulic Pump

The hydraulic pump 2 is a bent axis type hydraulic pump, the input shaft of which is connected to the output shaft of the engine 1 and which is driven by the engine 1 to suck in the hydraulic work fluid stored in the hydraulic work fluid tank 8, delivering it as the hydraulic fluid for driving the hydraulic actuator 9. This hydraulic pump 2 is of the variable displacement type, and its capacity varies in accordance with the angle (tilting angle) of the variable displacement mechanism including a cylinder block with respect to the input shaft. The pilot pump 3 is of the fixed displacement type, and outputs the initial pressure of the operation pressure px generated by the operation device 11 of the pilot operation type. While in the present embodiment the pilot pump 3 is driven by the engine 1, in some cases, it is driven by a separately provided motor (not shown) or the like.

The revolution speed of the engine 1 (e.g., a diesel engine) driving the hydraulic pump 2 is set by an engine controller dial (EC dial) 12. The EC dial 12 is a dial type operation device outputting a signal in accordance with the setting by the EC dial 12 to the machine body controller 30 (directing the setting of the revolution speed). The EC dial 12 makes it possible to steplessly direct the minimum value and the maximum value of the direction possible range of the revolution speed of the engine 1 and a value therebetween. The EC dial 12 is provided at a position within reach of the operator seated on the driver's seat within the cab 90. The engine 1 is controlled by an engine controller 10. The engine controller 10 controls the driving of the engine 1 based on a control signal from the machine body controller 30 (directed revolution speed of the EC dial 12, or the like). Further, it outputs information such as the revolution speed and fuel injection amount obtained from the engine 1 to the machine body controller 30.

(1-2. 2) Operation Device

The operation device 11 is a pilot operation type operation device generating a command pressure directing the operation of the hydraulic actuator 9. There is provided at least one operation device in correspondence with the number of the hydraulic actuators 9 driven by the same hydraulic pump 2. In FIG. 2, there is picked out a circuit operating the hydraulic actuator 9 in one direction, so that there is only shown a signal line 11*b* corresponding to the operation in one direction of an operation lever 11*a*. Actually, however, the operation lever 11*a* is operated in two directions, and there exists a signal line for each operating direction. (See the signal lines 11*b* and 11*c* in FIG. 3).

Further, the operation device 11 is provided at a position within reach of the operator seated on the driver's seat inside the cab 90. In FIG. 2, the operation lever device is an example of the operation device 11. The operation pressure px in accordance with the operation (operation amount) of the operation lever 11*a* is generated using the delivery pressure p0 of the pilot pump 3 as the initial pressure, and is output to a control valve 4. As a result, there is driven the control valve 4 and, by extension, the hydraulic actuator 9.

(1-2. 3) Control Valve

The control valve 4 is, for example, a hydraulic drive type control valve controlling the direction and flow rate of the hydraulic fluid supplied to the hydraulic actuator 9 from the hydraulic pump 2, and is provided in a delivery line 2*a* of the hydraulic pump 2. There is provided at least one control valve 4 in correspondence with the number of the hydraulic actuators 9 driven by the same hydraulic pump 2. FIG. 2 only shows the circuit of one-way operation of the hydraulic actuator 9, so that there is only shown an actuator line 9*a* connected to one hydraulic fluid chamber of the hydraulic actuator 9. Actually, however, there also exists an actuator line connected to the other hydraulic fluid chamber of the hydraulic actuator 9. The connection relationship of the actuator line with respect to the delivery line 2*a* of the hydraulic pump 2 is switched by the control valve 4 in accordance with the operating direction of the operation device 11, and the operating direction of the hydraulic actuator 9 is switched.

(1-2. 4) High Pressure Selection Valve

Figure 3:
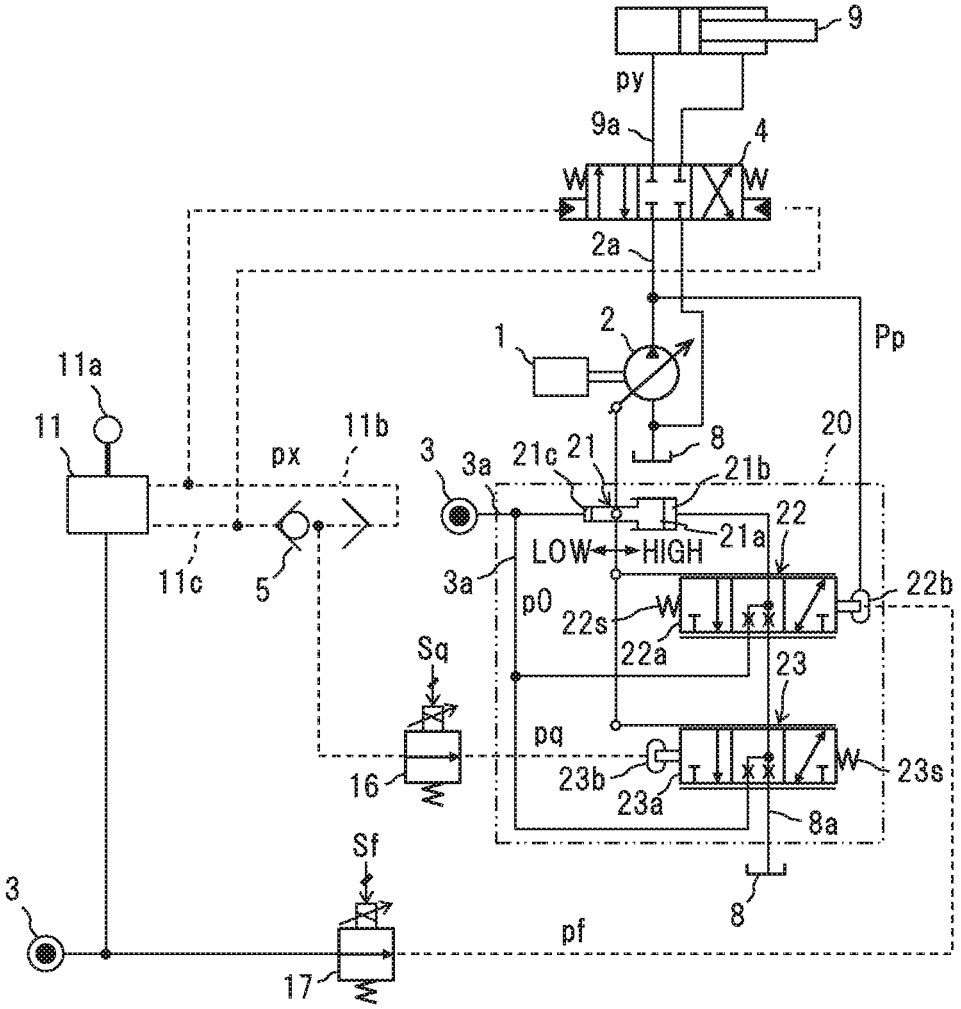
FIG. 3 is a hydraulic circuit diagram illustrating the construction of a regulator provided in the pump control system of the first embodiment of the present invention together with a related element.

The high pressure selection valve 5 is, for example, a shuttle valve provided in signal lines 11*b* and 11*c* of the operation device 11 (See also FIG. 3). It selects the higher of the operation pressures px of the signal lines 11*b* and 11*c*, and outputs the higher one. The operation pressure px output to the signal line 11*b* from the operation device 11 is output to the control valve 4. Further, in the case where the operation pressure px of the signal line 11*b* is selected by the high pressure selection valve 5, it is also output to the signal line 13. When there exist a plurality of operation devices 11, the number of the high pressure selection valves 5 also increases in correspondence with the number of the operation devices 11.

(1-2. 5) Sensor

The load pressure sensor 6 detects the load pressure (actuator pressure) py of the hydraulic actuator 9, and the operation pressure sensor 7 detects the operation pressure px of the operation device 11, with the sensors outputting the pressures to the machine body controller 30 (described below). The load pressure sensor 6 is provided in the actuator line 9*a* connecting the control valve 4 and one hydraulic fluid chamber of the hydraulic actuator 9 (the bottom side hydraulic fluid chamber in FIG. 2). In the case, however, where there is only one hydraulic actuator 9 driven by the hydraulic pump 2, the load pressure sensor 6 may be provided in the delivery line 2*a*. The operation pressure sensor 7 is provided in the signal line 11*b* connecting the operation device 11 and the high pressure selection valve 5. While FIG. 2 only shows one load pressure sensor 6 and one operation pressure sensor 7 related to the one-way operation of the hydraulic actuator 9, there actually also exist a load pressure sensor 6 and an operation pressure sensor 7 related to the other-way operation. Further, in the case where a plurality of hydraulic actuators 9 are driven by the same hydraulic pump 2, there are provided load pressure sensors 6 and operation pressure sensors 7 in numbers corresponding to the number of hydraulic actuators 9. That is, the number of sets of load pressure sensors 6 and operation pressure sensors 7 is double the number of hydraulic actuators 9.

(1-2. 6) Display Device

Apart from a display section 14*a* displaying various kinds of information related to the work machine, the display device 14 is equipped with an operation section 14*b* for performing various operation inputs, and a display controller (not shown) outputting display signals of various items of information in accordance with an input signal. Based on a command from the machine body controller 30, the display controller outputs a signal to the display section 14*a* and causes the display section 14*a* to display various meters and various items of machine body information. In accordance with the display information of the display section 14*a*, the operator can check the situation of the work machine. The display section 14*a* may also serve as an operation section 14*b* consisting of a touch panel type liquid crystal monitor. The display device 14 is provided inside the cab 90 along with the operation device 11, the EC dial 12, and the machine body controller 30.

(1-3) Pump Control System

The pump control system is a system for controlling the pump capacity of the hydraulic pump 2. When the pump revolution speed is fixed, the delivery flow rate (hereinafter referred to as the pump flow rate Qp) of the hydraulic pump 2 varies in proportion to the pump capacity. Thus, in the present embodiment, the capacity control of the hydraulic pump 2 will be referred to as the pump flow rate control. The pump control system according to the present embodiment is equipped with a flow rate control solenoid valve 16, a horsepower control solenoid valve 17, a regulator 20, and the machine body controller 30. The flow rate control solenoid valve 16 and the horsepower control solenoid valve 17 are controlled by the machine body controller 30, and the regulator 20 is controlled by the flow rate control solenoid valve 16, the horsepower control solenoid valve 17, and the delivery pressure of the hydraulic pump 2 (hereinafter referred to as the pump delivery pressure Pp). The pump flow rate is controlled by the regulator 20. In the following, the elements will be described one by one.

(1-3. 1) Flow Rate Control Solenoid Valve

The flow rate control solenoid valve 16 is a proportional solenoid valve, and is driven by a flow rate control signal Sq [mA] which is a current command value, generating a flow rate control pressure pq using the operation pressure px output from the high pressure selection valve 5 as the initial pressure (through a reduction in pressure). The flow rate control pressure pq is a hydraulic signal driving a pump flow rate control valve 23 (FIG. 3) of the regulator 20. While in the present embodiment the initial pressure of the flow rate control pressure pq is used as the operation pressure, the delivery pressure p0 of the pilot pump 3 may be used as the initial pressure of the flow rate control pressure pq. When the flow rate control pressure pq is minimum (which, in the present embodiment, is 0 MPa), the pump flow rate Qp is minimum, and when the flow rate control pressure pq is maximum (which, in the present embodiment, is 4 MPa), the pump flow rate Qp is maximum.

(1-3. 2) Horsepower Control Solenoid Valve

The horsepower control solenoid valve 17 is a proportional solenoid valve, and is driven by a horsepower control signal Sf [mA] which is a current command value, generating a horsepower control pressure pf which is a control signal of the limited horsepower (hereinafter referred to as the limited horsepower F) of the hydraulic pump 2, using the delivery pressure p0 of the pilot pump 3 as the initial pressure (through a reduction in pressure). The horsepower control pressure pf is a hydraulic signal driving a pump horsepower control valve 22 (FIG. 3) of the regulator 20. As described below, the urging force due to the horsepower control pressure pf is combined with the spring force of a pump horsepower control valve 22, and this combined force (first urging force) varies, whereby the limited horsepower F determined by the pump horsepower control valve 22 varies. When the horsepower control pressure pf is minimum (e.g., 0 MPa), the limited horsepower F is maximum (maximum limited horsepower Fmax), and when the horsepower control pressure pf is maximum (e.g., 4 MPa), the limited horsepower F is minimum (minimum limited horsepower Fmin).

(1-3. 3) Regulator

FIG. 3 is a hydraulic circuit diagram illustrating the construction of the regulator 20 along with the related elements. The regulator 20 shown in FIG. 3 is equipped with a servo piston device 21, a pump horsepower control valve 22, and a pump flow rate control valve 23. The construction of the servo piston device 21, the pump horsepower control valve 22, and the pump flow rate control valve 23 will be described one by one.

Servo Piston Device

The servo piston device 21 is equipped with a servo piston 21*a*, a large diameter cylinder chamber 21*b*, and a small diameter cylinder chamber 21*c*. The servo piston 21*a* is connected to the variable displacement mechanism of the hydraulic pump 2 via a link, and varies the pump flow rate Qp (tilting angle) through displacement. The small cylinder chamber 21*c* is directly connected to the delivery line 3*a* of the pilot pump 3, and the delivery pressure p0 of the pilot pump 3 is constantly input thereto. The large diameter cylinder chamber 21*b* has a pressure reception area larger than that of the small cylinder chamber 21*c*. In the present embodiment, the pressure acting on the large diameter cylinder chamber 21*b* is referred to as the servo pressure. The delivery line 3*a* of the pilot pump 3 is connected to the large diameter cylinder chamber 21*b* via the pump horsepower control valve 22 and the pump flow rate control valve 23. Thus, when the servo pressure increases, the servo piston 21*a* moves to the left as seen in the drawing due to the difference in pressure reception area between the large diameter cylinder chamber 21*b* and the small diameter cylinder chamber 21*c*, and the pump flow rate Qp decreases. On the other hand, when the servo pressure is reduced, the servo piston 21*a* moves to the right as seen in the drawing due to the urging force acting on the small diameter cylinder chamber 21*c*, and the pump flow rate Qp increases.

Pump Horsepower Control Valve

The pump horsepower control valve 22 is a valve controlling the servo pressure such that the absorption horsepower of the hydraulic pump 2 does not exceed the limited horsepower F to control the pump flow rate Qp, and is situated between the servo piston device 21 and the pump flow rate control valve 23. The pump horsepower control valve 22 is equipped with a pressure control spool 22*a* (hereinafter referred to as the spool 22*a*), a pressure receiving chamber 22*b*, and a spring 22*s*. Formed in the spool 22*a* is a flow line such that the connection destination of the large diameter cylinder chamber 21*b* of the servo piston 21*a* is switched either to the delivery line 3*a* of the pilot pump 3 or to a tank line 8*a* of the hydraulic working fluid tank 8 in accordance with the spool position. The pressure receiving chamber 22*b* is provided on one side of the spool 22*a*, and the spring 22*s* is provided on the other side. The pump pressure Pp is input to the pressure receiving chamber 22*b*. The spring 22*s* determines the maximum value of the limited horsepower F (maximum limited horsepower Fmax) with the spring force, and urges the spool 22*a* from the other side against the urging force due to the pump pressure Pp. Due to this construction, the maximum value of the pump absorption horsepower is restricted by the maximum limited horsepower Fmax. That is, in a situation in which a pump absorption horsepower equal to or more than the maximum limited horsepower Fmax is required, the spool 22*a* is driven through an increase/decrease in the pump pressure Pp, and the pump flow rate Qp varies such that the pump absorption horsepower is fixed (=maximum limited horsepower Fmax). More specifically, in the case where a pump absorption horsepower equal to or more than the maximum limited horsepower Fmax is required, when the pump pressure Pp increases, the spool 22*a* goes to the left, and the large diameter cylinder chamber 21*b* is connected to the pilot pump 3, and the servo piston 21*a* goes to the left, and the pump flow rate Qp decreases. In contrast, when the pump pressure Pp decreases, the spool 22*a* goes to the right, and the large diameter cylinder chamber 21*b* is connected to the hydraulic working fluid tank 8, and the servo piston 21*a* goes to the right, and the pump flow rate QP increases.

At this time, in the present embodiment, the horsepower control pressure pf is input to the pressure receiving chamber 22*b* in addition to the pump pressure Pp, and the urging force due to the horsepower control pressure pf acts on the spool 22*a* against the urging force due to the spring 22*s*. Thus, the urging force due to the horsepower control pressure pf is combined with the urging force due to the spring 22*s* (the spring force is partially canceled by the urging force due to the horsepower control pressure pf). That is, the limited horsepower F is determined by the combined force acting on the spool 22*a* against the pump pressure Pp, and the limited horsepower F varies in accordance with the horsepower control pressure pf. In the present embodiment, when the horsepower control pressure pf is minimum, the limited horsepower F is the maximum limited horsepower Fmax, and when the horsepower control pressure pf is maximum, the limited horsepower F is the minimum limited horsepower Fmin. In the specification of the present application, the combined force of the urging force due to the spring 22*s* and the urging force due to the horsepower control pressure pf is referred to as the first urging force, and the urging force due to the pump pressure Pp is referred to as the second urging force.

In the present embodiment, the pump horsepower control valve 22, and the like are constructed such that the pump pressure corresponding to the minimum pump flow rate is higher than the minimum pump pressure with respect to the minimum limited horsepower Fmin (FIG. 4) determined by the pump horsepower control valve 22. This is effected through the setting of the maximum value of the horsepower control pressure pf, the pressure reception area of the pressure receiving chamber 22*d*, the spring force of the spring 22*s*, the stroke amount of the spool 22*a*, the construction of the flow line, or the like.

Figure 4:
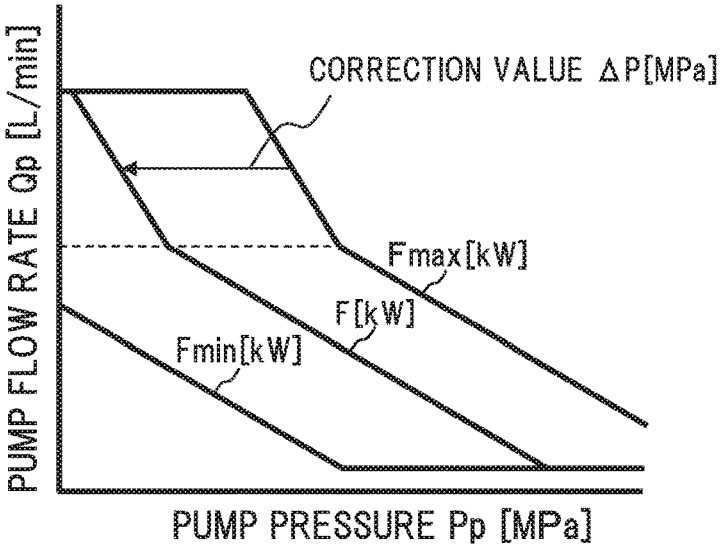
FIG. 4 is an explanatory view illustrating a limited horsepower which is determined by a pump horsepower control valve provided in the pump control system of the first embodiment of the present invention.

FIG. 4 is an explanatory view of the limited horsepower F determined by the pump horsepower control valve 22. In the drawing, the maximum limited horsepower Fmax is the characteristic of the pump flow rate Qp with respect to the pump pressure Pp when the horsepower control pressure pf is minimum (e.g., 0 MPa). In this case, the hydraulic pump 2 can output the largest horsepower. The minimum limited control horsepower Fmin is the characteristic of the pump flow rate Qp with respect to the pump pressure Pp when the horsepower control pressure pf is maximum (e.g., 4 MPa). In this case, the horsepower that the hydraulic pump 2 can output is suppressed to a minimum. The limited horsepower F (including the maximum limited horsepower Fmax and the minimum limited horsepower Fmin) is determined by the first urging force of the pump horsepower control valve 22. Thus, it is not a curve-like characteristic in which the pressure multiplied by the flow rate is fixed but a linear (line-graph-like) characteristic imparted by the spring 22*s*. The limited horsepower F translates in the pump pressure axis direction (in the horizontal axis direction in the drawing) between Fmax and Fmin in accordance with the horsepower control pressure pf.

In the present embodiment, when the maximum limited horsepower Fmax is a reference, the deflection amount in the pump pressure axis direction of the limited horsepower F is referred to as the correction value ΔP. The relationship between the horsepower control pressure pf, the correction value ΔP, and the horsepower control signal Sf is determined by the characteristics (specifications) of the hydraulic pump 2, the regulator 20, and the horsepower control solenoid valve 17, so that they allow mutual conversion.

Pump Flow Rate Control Valve

The pump flow rate control valve 23 is a valve driven by the flow rate control pressure pq to control the servo pressure to control the pump flow rate Qp, and is equipped with a flow rate control spool 23*a* (hereinafter referred to as the spool 23*a*), a pressure receiving chamber 23*b*, and a spring 23*s*. Formed in the spool 23*a* is a flow line such that the connection destination of the large diameter cylinder chamber 21*b* of the servo piston 21*a* is switched to either the delivery line 3*a* of the pilot pump 3 or the tank line 8*a* connected to the hydraulic working fluid tank 8 in accordance with the position thereof. The spring 23*s* is provided on one side of the spool 23*a*, and the pressure receiving chamber 23*b* is provided on the other side thereof. The flow rate control pressure pq is input to the pressure receiving chamber 23*b*, and the spool 23*a* moves through the increase/decrease of the urging force due to the flow rate control pressure pq. Due to this construction, when the flow rate control pressure pq increases in accordance with the operation amount of the operation device 11, the spool 23*a* moves to the right, and the large diameter cylinder chamber 21*b* is connected to the hydraulic working fluid tank 8, and the servo piston 21*a* moves to the right and the pump flow rate Qp increases. When the flow rate control pressure pq is reduced, the spool 23*a* moves to the left, and the large diameter cylinder 21*b* is connected to the pilot pump 3, and the servo piston 21*a* moves to the left and the pump flow rate Qp decreases. In this way, the pump capacity is controlled in accordance with the operation amount of the operation device 11.

The pump flow rate control valve 23 is connected to the servo piston device 21 in series with the pump horsepower control valve 22. Of the pressure controlled by the pump horsepower control valve 22 and the pressure controlled by the pump flow rate control valve 23, the lower pressure serves as the servo pressure. That is, the pump flow rate Qp is hydraulically controlled by the smaller one of the value determined by the pump horsepower control valve 22 and the value controlled by the pump flow rate control valve 23.

Figure 5:
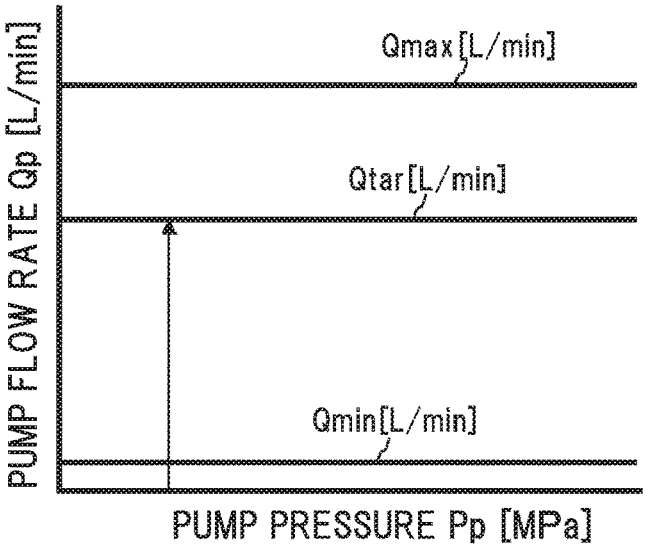
FIG. 5 is an explanatory view illustrating a limited pump flow rate determined by a pump flow rate control valve provided in the pump control system of the first embodiment of the present invention.

FIG. 5 is an explanatory view of the limited pump flow rate determined by the pump flow rate control valve. In the drawing, on the assumption that it is not applied to the limited horsepower F, the maximum pump flow rate Qmax is the characteristic of the pump flow rate Qp with respect to the pump pressure Pp when the flow rate control pressure pq is maximum (4 MPa). That is, it is the maximum value of the pump flow rate Qp attained through positive control. On the other hand, the characteristic of the pump flow rate Qp with respect to the pump pressure Pp when the flow rate control pressure pq is minimum (0 MPa) is the minimum pump flow rate Qmin (the minimum value of the pump flow rate Qp attained through positive control). The target pump flow rate Qtar described below varies between Qmin and Qmax in accordance with the flow rate control pressure pq.

The relationship between the flow rate control pressure pq, the target pump flow rate Qtar, and the flow rate control signal Sq is determined by the characteristics (specifications) of the hydraulic pump 2, the regulator 20, and the flow rate control solenoid valve 16, so that they allow mutual conversion.

(1-3. 4) Machine Body Controller

Figure 6:
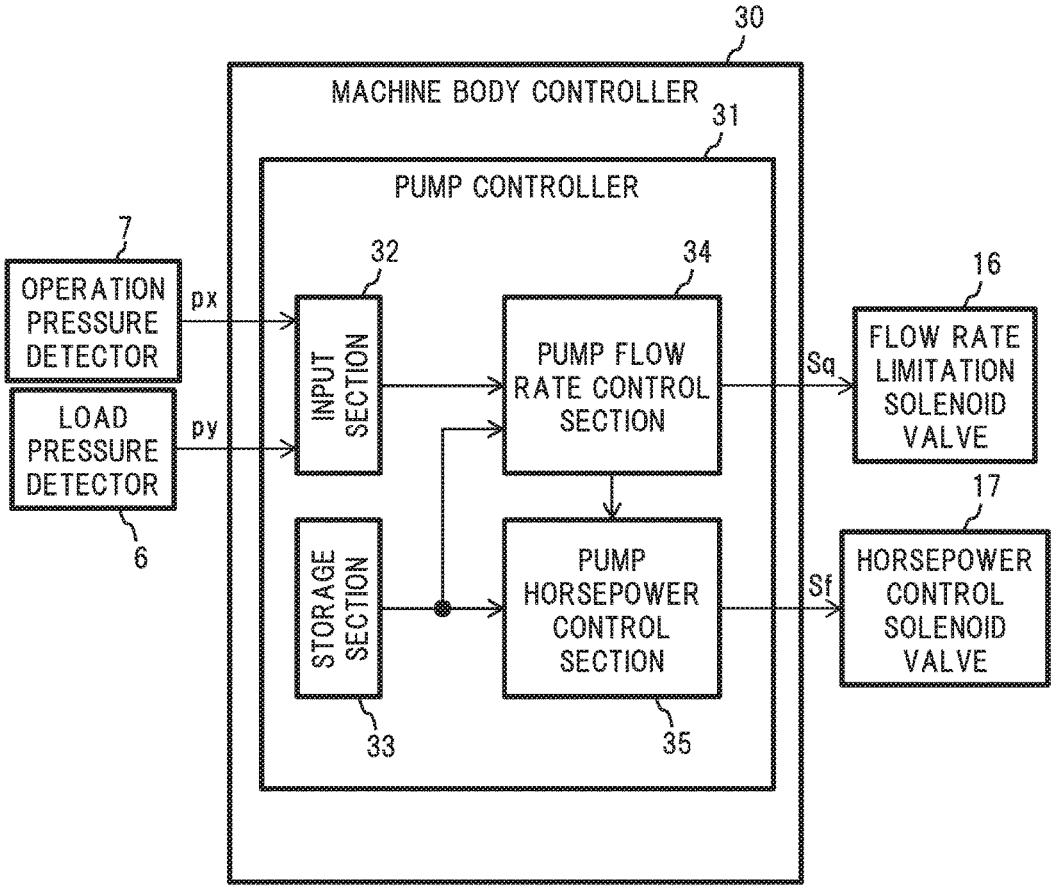
FIG. 6 is a schematic diagram illustrating a machine body controller including a pump controller provided in the pump control system of the first embodiment of the present invention.

FIG. 6 is a schematic view of the machine body controller 30. The machine body controller 30 controls the operation of the work machine as a whole. The machine body controller 30 inputs therein signals from the load pressure sensor 6, the operation pressure sensor 7, the EC dial 12, and the like, and, based on these signals, the machine body controller 30 outputs command signals to the engine controller 10, the flow rate control solenoid valve 16, the horsepower control solenoid valve 17, and the like. In particular, the machine body controller 30 includes a pump controller 31 which outputs command signals (flow rate control signal Sq and horsepower control signal Sf) to the flow rate control solenoid valve 16 and the horsepower control solenoid valve 17, and which serves to control the pump flow rate Qp.

(1-4) Pump Controller

The pump controller 31 is equipped with an input section 32, a storage section 33, a pump flow rate control section 34, and a pump horsepower control section 35. The input section 32 is a function section inputting the operation pressure px detected by at least one operation pressure sensor 7 and the load pressure py detected by at least one load pressure sensor 6. The storage section 33 stores the requisite information for computing and outputting the horsepower control signal Sf and the flow rate control signal Sq, such as a program and a control table (described below). Next, the pump flow rate control section 34 and the pump horsepower control section 35 will be described.

(1-4. 1) Pump Flow Rate Control Section

Figure 7:
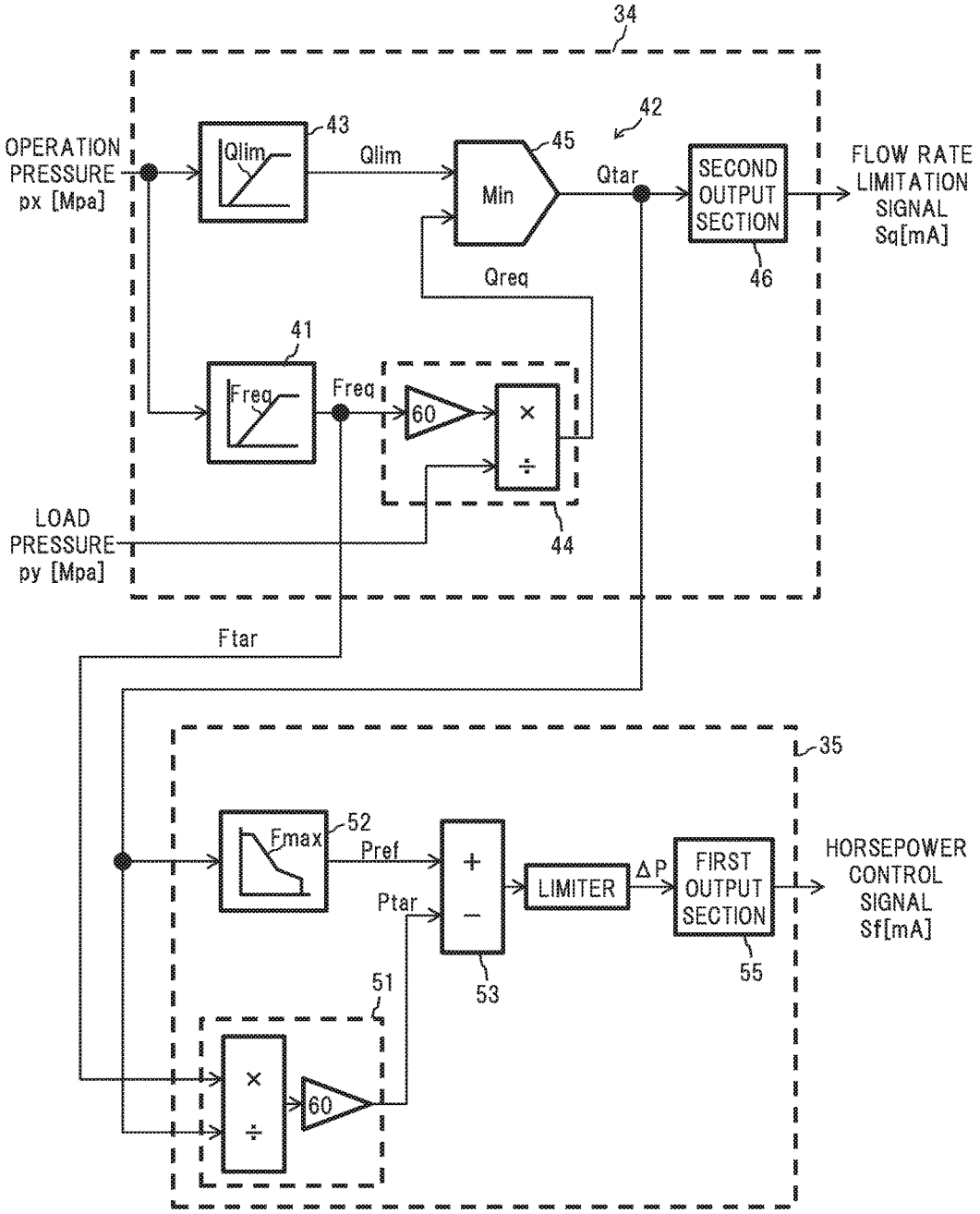
FIG. 7 is a function block diagram of a pump flow rate control section and a pump horsepower control section provided in the pump control system of the first embodiment of the present invention.

FIG. 7 is a functional block diagram illustrating the pump flow rate control section 34 and the pump horsepower control section 35. As shown in the drawing, the pump flow rate control section 34 is equipped with a target horsepower computation section 41, a target pump flow rate computation section 42, and a second output section 46. The pump flow rate control section 34 serves to determine a target pump flow rate Qtar for operating the hydraulic actuator 9 with a required horsepower Freq the standard of which is determined in accordance with the operation pressure px. At the same time, the pump flow rate control section 34 of the present embodiment serves to positively (actively) control the pump flow rate Qp based on the target pump flow rate Qtar. The pump flow rate computed and controlled by the pump flow rate control section 34 presupposes the operation of the hydraulic pump 2 with the target horsepower Ftar (described below). From this viewpoint, in the present specification, the function of the pump flow rate control section 34 will be referred to as "electronic horsepower control" for the sake of convenience. In the following, the elements will be described one by one.

Target Horsepower Computation Section

The target horsepower computation section 41 is a function section computing the required horsepower Freq corresponding to the operation pressure px detected by at least one operation pressure sensor 7 from a relationship related to the operation pressure px of the corresponding operation device 11, and then computing the target horsepower Ftar based on the at least one required horsepower Freq. As described above, the required horsepower Freq is the standard of the horsepower required by the corresponding hydraulic actuator 9 with respect to the operation pressure px, and the target horsepower Ftar is the sum total of the required horsepowers Freq (In the case where there is only one required horsepower Freq, Ftar=Freq). The required horsepower Freq is the horsepower required of the hydraulic actuator 9, whereas the target horsepower Ftar is the horsepower required of the hydraulic pump 2. In the present embodiment, the storage section 33 stores a control table determining the relationship of the required horsepower Freq with respect to the operation pressure px. With the input of the operation pressure px, the target horsepower computation section 41 reads the corresponding control table from the storage section 33, and computes the required horsepower Freq corresponding to the operation pressure px by using the control table read.

Figure 8:
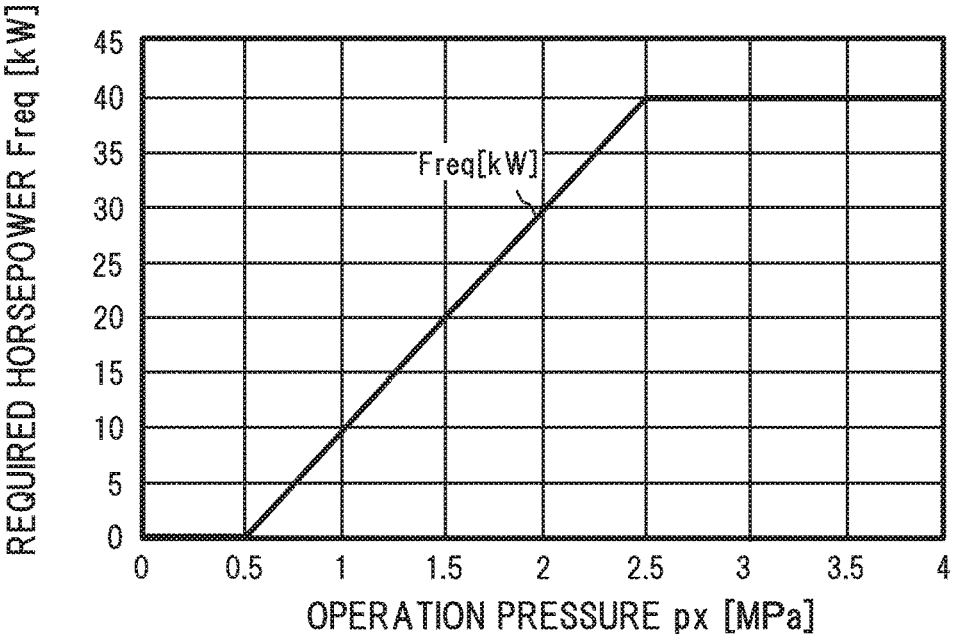
FIG. 8 is a diagram illustrating an example of a control table read by a target horsepower computation section provided in the pump control system of the first embodiment of the present invention.

FIG. 8 is a diagram illustrating an example of the control table read by the target horsepower computation section 41. As shown in the drawing, the characteristic of the required horsepower Freq is set, for example, such that it increases with the increase in the operation pressure px. In the case where there are a plurality of operation devices 11, the characteristic of the required horsepower Freq as shown in the drawing is prepared for the operating direction of each operation device 11. Further, as the characteristic for combined operation, there is prepared the characteristic of the required horsepower Freq which differs depending on which operation devices 11 are operated at the same time even if the same operation devices 11 are operated in the same direction. In the case of a combined operation, each required horsepower Freq is so to speak the items of the target horsepower Ftar, so that even when the same operation devices 11 are operated in the same direction, it is set to be lower as compared with the characteristic in the case of a single operation. In the case where a single operation is performed, the target horsepower computation section 41 reads from the storage section 33 the characteristic corresponding to the kind of operation pressure px input, and, based on the characteristic, computes the single required horsepower Freq corresponding to the operation pressure px as the target horsepower Ftar. In the case where a combined operation is performed, the target horsepower computation section 41 reads from the storage section 33 a plurality of characteristics in accordance with the kind and combination of the plurality of operation pressures px input, and computes the target horsepower Ftar by summing up the plurality of required horsepowers Freq for each operation pressure px computed based on each characteristic. The required horsepower Freq is output to the required flow rate computation section 44, and the target horsepower Ftar is output to the pump horsepower control section 35.

Target Pump Flow Rate Computation Section

The target pump flow rate computation section 42 is a function section which computes the target pump flow rate Qtar of the hydraulic pump 2, based on the operation pressure px detected by at least one operation pressure sensor 7 and on the load pressure py detected by at least one load pressure sensor 6. The target pump flow rate computation section 42 is equipped with a required flow rate computation section 44, a limited flow rate computation section 43, and a selection output section 45.

Required Flow Rate Computation Section

The required flow rate computation section 44 is a function section computing the required flow rate Qreq based on at least one required horsepower Freq computed by the target horsepower computation section 41 and on the corresponding load pressure py. Here, the required flow rate Qreq computed is the pump flow rate Qp required when operating the corresponding hydraulic actuator 9 with the required horsepower Freq. The required flow rate computation section 44 of the present embodiment is composed of a multiplier and a divider, and the required flow rate Qreq is computed by (Equation 1).

$$Qreq=(Freq/py)\times 60 \quad (1)$$

In this example, the units employed are as follows: the required flow rate Qreq: [L/min], the required horsepower Freq: [kW], and the load pressure py: [MPa].

Strictly speaking, the sum total of the values computed by (Equation 1) is the required flow rate Qreq. Thus, in the case where a plurality of required horsepowers Freq is computed by the target horsepower computation section 41, the sum total of a plurality of values obtained by (Equation 1) from the load pressure py corresponding to each required horsepower Freq is output as the required flow rate Qreq. In the case where a single required horsepower Freq is computed by the target horsepower computation section 41, the value obtained by (Equation 1) from the load pressure py corresponding to the required horsepower Freq is the required flow rate Qreq.

Limited Flow Rate Computation Section

The limited flow rate computation section 43 is a function section computing the limited flow rate Qlim of the hydraulic pump 2 in accordance solely with the operation pressure px. Here, the limited flow rate Qlim obtained is a limited value of the pump flow rate Qp varying solely in accordance with the operation pressure px. In other words, the limited flow rate Qlim is the maximum pump flow rate Qp that the hydraulic pump 2 can deliver with respect to the operation pressure px under the condition in which the horsepower limitation due to the pump horsepower control valve 22 is not exerted. In the present embodiment, the storage section 33 stores a control table determining the relationship of the limited flow rate Qlim with respect to the operation pressure px. The limited flow rate computation section 43 reads a corresponding control table from the storage section 33 with the input of the operation pressure px, and computes the limited flow rate Qlim in accordance with the operation pressure px by using the control table read.

Figure 9:
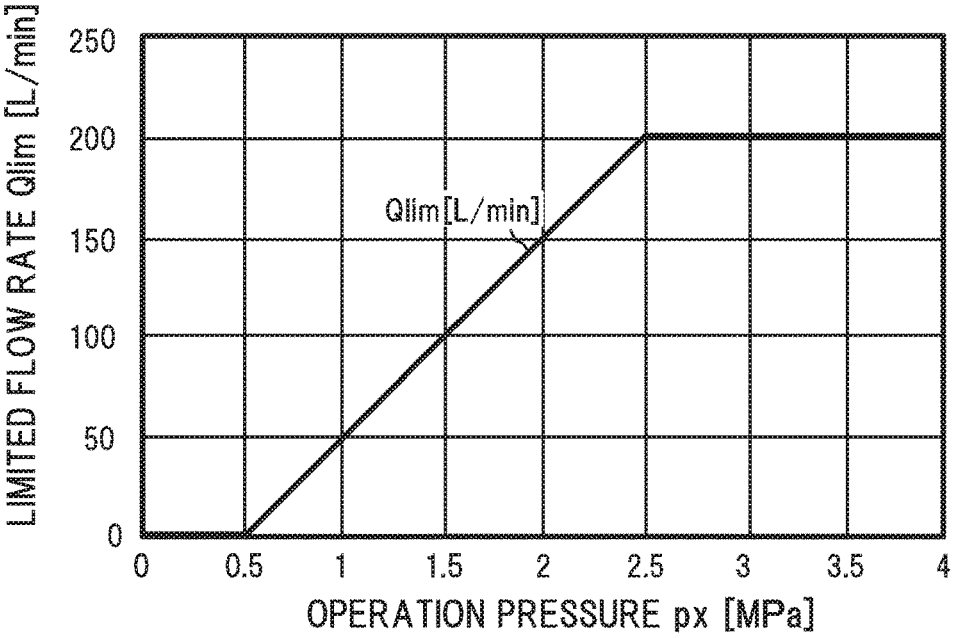
FIG. 9 is a diagram illustrating an example of a control table read by a limited flow rate computation section provided in the pump control system of the first embodiment of the present invention.

FIG. 9 is a diagram illustrating an example of the control table read by the limited flow rate computation section 43. As shown in the drawing, the characteristic of the limited flow rate Qlim is set, for example, such that it increases as the operation pressure px increases. As in the case of the required horsepower Freq, in the case where there exist a plurality of operation devices 11, there is prepared the characteristic of the limited flow rate Qlim as shown in the drawing for the operating direction of each operation device 11. Further, as characteristics for a combined operation, there are prepared characteristics of limited flow rates Qlim differing by the kind of operation simultaneously performed even when the same operation devices 11 are operated in the same direction. Even when the same operation devices 11 are operated in the same direction, the limited flow rate Qlim for a combined operation is set lower than the characteristic for a single operation. When a single operation is performed, the limited flow rate computation section 43 reads, from the storage section 33, a characteristic corresponding to the kind of operation pressure px input, and computes a singe limited flow rate Qlim in accordance with the operation pressure px based on the characteristic. When a combined operation is performed, the limited flow rate computation section 43 reads a plurality of characteristics from the storage section 33 in accordance with the kind and combination of the plurality of operation pressures px input, and sums up the limited flow rates Qlim for the operation pressures px (The sum total is the final limited flow rate Qlim).

Selection Output Section

The selection output section 45 is a function section which selects the lower of the limited flow rate Qlim and the required flow rate Qreq as the target pump flow rate Qtar, and outputs the value of the target pump flow rate Qtar to a target pump pressure computation section 51 (described below), a reference pump pressure computation section 52 (described below), and a second output section 46.

Second Output Section

The second output section 46 is a function section which generates a flow rate control signal Sq [mA] in accordance with the target pump flow rate Qtar input from the selection output section 45, and outputs it to the flow rate control solenoid valve 16. When the solenoid is excited by the flow rate control signal Sq, the opening of the flow rate control solenoid valve 16 is controlled, and the flow rate control pressure pq is generated at the flow rate control solenoid valve 16, with the pump flow rate control valve 23 being driven. As a result, the capacity of the hydraulic pump 2 is positively controlled such that the target pump flow rate Qtar is delivered.

(1-4. 2) Pump Horsepower Control Section

The pump horsepower control section 35 is equipped with a target pump pressure computation section 51, a reference pump pressure computation section 52, a correction value computation section 53, a limiter 54, and a first output section 55. The pump horsepower control section 35 serves to control the limited horsepower F with the target pump flow rate Qp determined by the pump flow rate control section 34, such that the horsepower of the hydraulic pump 2 attains the target horsepower Ftar. In other words, it serve to control the pump flow rate Qp to the target pump flow rate Qtar by controlling the limited horsepower F to the target horsepower Ftar. In the following, each element will be described.

Target Pump Pressure Computation Section

The target pump pressure computation section 51 is a function section computing a target pump pressure Ptar corresponding to the target pump flow rate Qtar with respect to the target horsepower Ftar. The target pump pressure Ptar is the pump pressure Pp applied when delivering the target pump flow rate Qtar with the target horsepower Ftar. When the limited horsepower F is controlled to the target horsepower Ftar, the pump flow rate Qp is negatively controlled by the pump flow rate control section 34 in the state in which the horsepower control by the pump horsepower control valve 22 is being performed, this aims for delivering the target pump flow rate Qtar with the target pump pressure Ptar. The target pump pressure computation section 51 of the present embodiment is composed of a multiplier and a divider, and the target pump pressure Ptar is computed by (Equation 2).

$$Ptar=(Ftar/Qtar)\times 60 \quad (2)$$

In this example, the units employed are as follows: the target pump pressure Ptar: [MPa], the target horsepower Ftar: [kW], and the target pump flow rate Qtar: [L/min].

Reference Pump Pressure Computation Section

Figure 10:
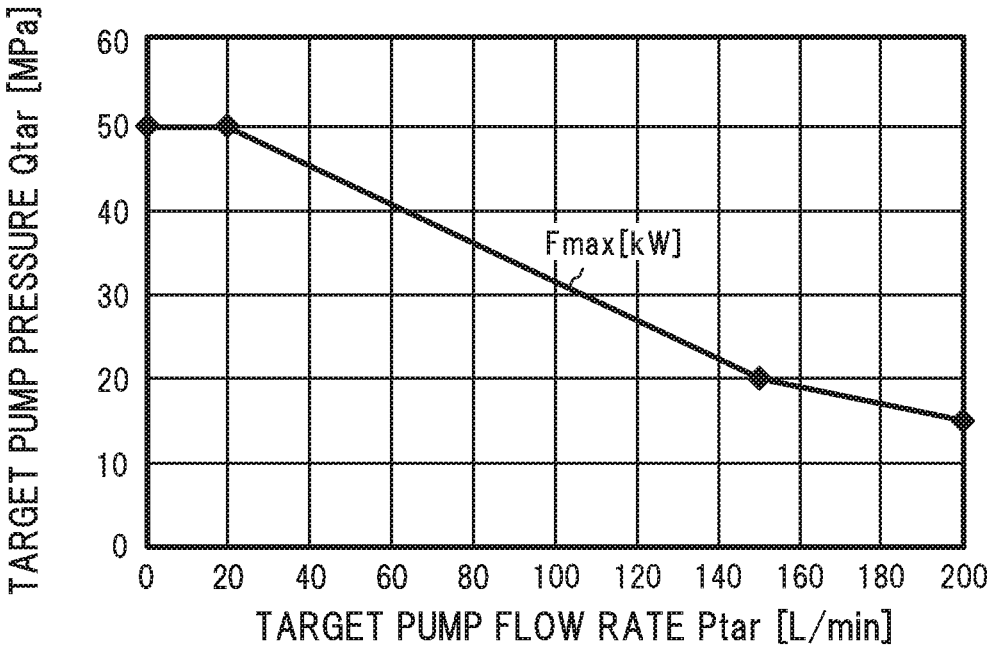
FIG. 10 is a diagram illustrating an example of a control table read by a reference pump pressure computation section provided in the pump control system of the first embodiment of the present invention.

The reference pump pressure computation section 52 is a function section which computes a reference pump pressure Pref corresponding to the target pump flow rate Qtar with respect to the reference limited horsepower (which, in this example, is the maximum limited horsepower Fmax shown in FIG. 4) determined by a straight line (line graph) in accordance with the characteristic of the spring 22*s* of the pump horsepower control valve 22. In the present embodiment, the storage section 33 stores a control table representing the characteristic of the pump pressure Pp with respect to the pump flow rate Qp at the maximum limited horsepower Fmax. The reference pump pressure computation section 52 reads the control table from the storage section 33 with the input of the target pump flow rate Qtar, and computes a reference pump pressure Pref corresponding to the target pump flow rate Qtar. FIG. 10 is a diagram illustrating an example of the control table read by the reference pump pressure computation section 52. The characteristic shown in FIG. 10 is equal to what is obtained by exchanging the horizontal axis and the vertical axis with respect to the maximum limited horsepower Fmax (horsepower control pressure pf=0 MPa) shown in FIG. 4.

Correction Value Computation Section

The correction value computation section 53 is a function section computing the correction value ΔP which is the correction value of the limited horsepower F with respect to the maximum limited horsepower Fmax by subtracting the target pump pressure Ptar from the reference pump pressure Pref. The correction value ΔP corresponds to the correction amount (control line shift amount) of the limited horsepower F using the maximum limited horsepower Fmax as a reference in the pressure flow rate coordinate system such that the hydraulic pump 2 operates under the condition of the limited horsepower F, the target pump pressure Ptar, and the target pump flow rate Qtar.

Limiter

The limiter 54 is a function section limiting the correction value ΔP computed by the correction value computation section 53 to a value equal to or more than 0 (zero). In the pressure flow rate coordinate system, the limited horsepower F determined by a straight line (line graph) and the target horsepower Ftar determined by a curved line differ from each other in configuration. Thus, depending on the condition, the target pump pressure Ptar can be higher than the reference pump pressure Pref, and the correction value $\Delta P<0$. The maximum limited horsepower Fmax, however, cannot be increased, so that, in the present embodiment, the minimum value of the correction value ΔP is limited to 0 by the limiter 54. Due to the limiter 54, ΔP is output when $\Delta P\geq 0$, and 0 is output when $\Delta P<0$, as the correction value ΔP.

First Output Section

The first output section 55 is a function section which generates a horsepower control signal Sf [mA] in accordance with the correction value ΔP, and outputs it to the horsepower control solenoid valve 17. The solenoid is excited by the horsepower control signal Sf, whereby the opening of the horsepower control solenoid valve 17 is controlled, and the horsepower control pressure pf is generated by the horsepower control solenoid valve 17 and added to the pump horsepower control valve 22. As a result, the first urging force acting on the spool 22*a* of the pump horsepower control valve 22 is changed, and the characteristic (horsepower line) of the limited horsepower F due to the pump horsepower control valve 22 attains a value shifted from the maximum limited horsepower Fmax by the correction value ΔP. In calculation, with the target pump pressure Ptar, the limited horsepower F after control coincides with the target horsepower Ftar (curved line).

(1-5) Operation

Figure 11:
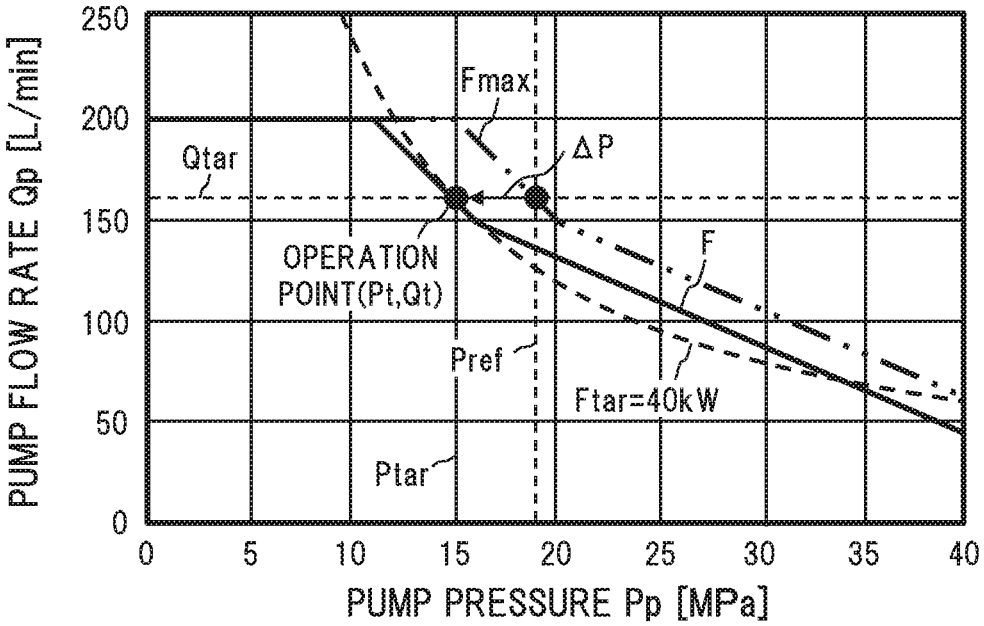
FIG. 11 is an explanatory view illustrating a pump operation controlled by the pump control system of the first embodiment of the present invention.

FIG. 11 is an explanatory view illustrating a pump operation controlled by the pump control system of the present embodiment. Here, solely a one-way operation of the single operation device 11 is conducted. By way of example, to be described will be the case where the operation pressure px detected by the corresponding operation pressure sensor 7 is 4 MPa and where the load pressure py detected by the corresponding load pressure sensor 6 is 15 MPa.

Processing of Pump Flow Rate Control Section (Electronic Horsepower Control)

The target horsepower Ftar (=required horsepower Freq) computed by the target horsepower computation section 41 is 40 kW (See FIG. 8), the limited flow rate Qlim computed by the limited flow rate computation section 43 is 200 L/min (See FIG. 9), and the required flow rate Qreq computed by the required flow rate computation section 44 is 160 L/min. Thus, the required flow rate Qreq is selected at the selection output section 45, and the value of 160 L/min is output as the target pump flow rate Qtar. At the second output section 46, the value of the target pump flow rate Qtar=160 L/min is converted to a flow rate control signal Sq [mA], and the flow rate control signal thus obtained is output to the flow rate control solenoid valve 16. As a result, the flow rate control pressure pq is generated at the flow rate control solenoid valve 16, and the pump flow rate control valve 23 is driven, with the result that there is delivered the target pump flow rate Qtar (160 L/min) causing the pump absorption horsepower to attain the target horsepower Ftar (40 kW).

Processing of Pump Horsepower Control Section (Limited Horsepower Control)

Through the computation processing by the pump flow rate control section 34, the target pump flow rate Qtar attains 160 L/min, the target pump pressure Ptar computed by the target pump pressure computation section 51 attains 15 MPa, and the reference pump pressure Pref computed by the reference pump pressure computation section 52 attains 19 MPa (See FIG. 10). Thus, the correction value ΔP computed by the correction value computation section 53 is 4 MPa. $\Delta P>0$, so that the value of 4 MPa is output from the limiter 54 as the correction value ΔP. At the first output section 55, the value of the correction value ΔP=4 MPa is converted to the horsepower control signal Sf [mA], and the horsepower control signal thus obtained is output to the horsepower control solenoid valve 17. As a result, the horsepower control pressure pf is generated at the horsepower control solenoid valve 17 and added to the pump horsepower control valve 22, with the result that, with the target pump pressure Ptar, the limited horsepower F coincides with the target horsepower Ftar (40 kW). That is, the limited horsepower F is controlled such that it is just applied to the hydraulic horsepower control due to the pump horsepower control valve 22 at the pump operation point (15 MPa, 160 L/min) due to the electronic horsepower control.

(1-6) Effect

Suppression of Pressure Hunting

The hydraulic pump 2 is controlled by the pump flow rate control section 34 (electronic horsepower control) to a target pump flow rate Qtar which attains the target horsepower Ftar with the load pressure py, and the limited horsepower F is controlled so as to aim at just the target horsepower Ftar due to the pump horsepower control valve 22 at the target pump flow rate Qtar. In other words, there are simultaneously conducted a positive (active) pump flow rate control using the pump flow rate control valve 23 and a pump flow rate control through the control of the limited horsepower F of the pump horsepower control section 35 controlling the pump flow rate negatively (passively). During the control operation, the hydraulic pump 2 operates in a state in which the horsepower control due to the pump horsepower control valve 22 is constantly exerted.

Here, in order that a target pump flow rate in accordance with the operation pressure may be output, the pump flow rate control valve controlling the hydraulic pump is usually intentionally constructed such that the loss of the spool flow line, the line connected thereto, the restrictor, or the like is large. This is for the purpose of causing the pump flow rate to follow so as to be a little delayed with respect to the spool displacement so that the pump flow rate may not increase or decrease excessively. On the other hand, the pump horsepower control valve, which controls the pump flow rate such that it does not exceed the limited horsepower in order to prevent an engine stall, is constructed such that the loss of the spool, or the like is smaller as compared with that of the pump flow rate control valve, causing the pump flow rate to vary with a satisfactory responsiveness with respect to the displacement of the spool.

According to the present embodiment, the hydraulic pump 2 operates in a state in which, as described above, it is constantly applied to the hydraulic horsepower control due to the pump horsepower control valve 22, so that the pump flow rate control due to the hydraulic horsepower control of the pump horsepower control valve 22 is constantly exerted. As a result, it is possible to shorten the deviation in time from the output of the command (flow rate control signal Sq, horsepower control signal Sf) from the pump controller 31 until the change in the pump flow rate, making it possible to achieve an improvement in terms of the responsiveness in the pump flow rate control. Through the improvement in terms of the responsiveness in the pump flow rate control, it is possible to suppress an excessive torque and pressure hunting due to an abrupt change in load during operation of the bent axis type hydraulic pump 2 having a heavy variable displacement mechanism and, by extension, to achieve an improvement in terms of operability and fuel efficiency.

Figure 12:
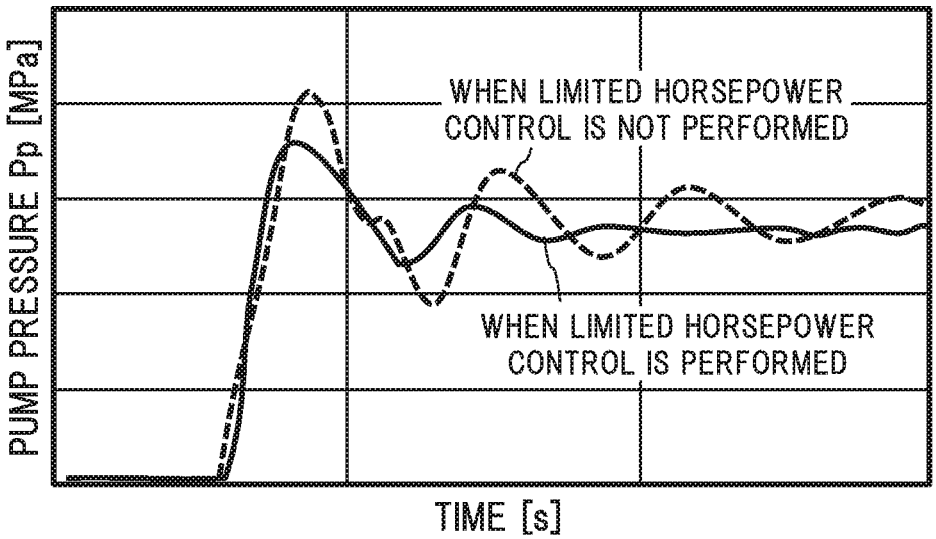
FIG. 12 is a diagram illustrating a difference in behavior of a pump pressure at the time of starting an actuator in accordance with the presence/absence of the limited horsepower control.

FIG. 12 is a diagram illustrating a difference in behavior of a pump pressure at the time of starting an actuator in accordance with the presence/absence of the limited horsepower control. As shown in the drawing, in the case where the limited horsepower control due to the pump horsepower control section 35 is executed along with the control of the pump flow rate control valve 23, it is possible to attenuate the fluctuations in pressure of the pump pressure Pp at the time of starting the actuator as compared with the case where solely the control of the pump flow rate control valve 23 is executed.

Generally speaking, the limited horsepower due to the pump horsepower control valve is fixed, and, in many cases, the pump horsepower control valve is provided solely for the purpose of negatively control the pump flow rate such that it does not exceed the maximum limited horsepower. In the case where the limited horsepower is fixed to the maximum limited horsepower, when the operation amount is large, the pump flow rate increases unless the maximum limited horsepower is exceeded even under a relatively high pump pressure, and, in some cases, the pump absorption horsepower becomes larger than necessary with respect to the nature of the work. In contrast, in the present embodiment, the hydraulic pump operates aiming at the target horsepower in accordance with the operation pressure, so that it is possible to suppress an increase in horsepower more than necessary. This also helps to contribute to achieving an improvement in terms of fuel efficiency.

Figure 13:
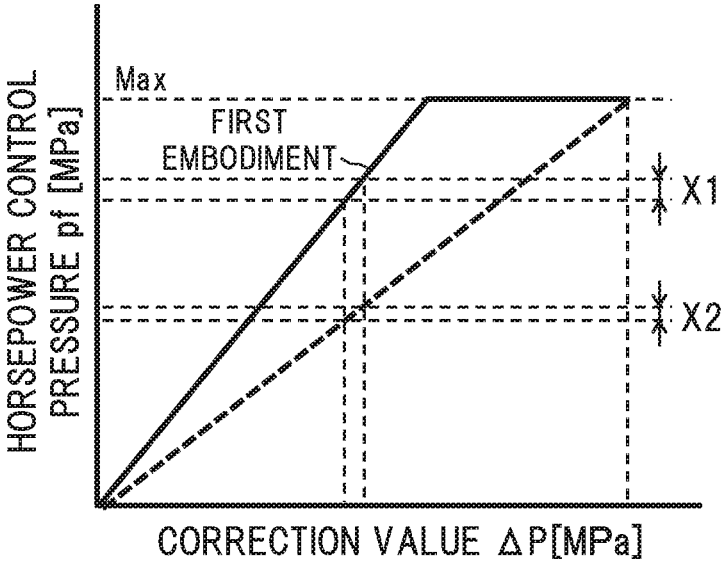
FIG. 13 is a diagram illustrating an example of the relationship between a correction value of the limited horsepower and a horsepower control pressure.

Securing of Accuracy in Pump Flow Rate Control through Limited Horsepower Control FIG. 13 is a diagram illustrating an example of the relationship between the correction value ΔP and the horsepower control pressure pf. The characteristic shown is the characteristic of the correction value ΔP with respect to the horsepower control pressure pf, that is, the characteristic determining how much the limited horsepower F can be reduced with the same horsepower control pressure pf. This characteristic is determined by various elements including the stroke amount of the spool 22*a* and the flow line construction, and how much the first urging force acting on the spool 22*a* of the pump horsepower control valve 22 can be reduced with the horsepower control pressure pf. Thus, the spool 22*a* is constructed such that the pump flow rate Qp can be varied from minimum to maximum (such that the servo piston 21*a* can be moved full stroke), and that the first urging force varies from 0 (zero) to maximum within the variation range of the horsepower control pressure pf, whereby it is possible to operate the hydraulic pump 2 in a state in which the horsepower control by the pump horsepower control valve 22 is exerted in the entire pressure flow rage region (which is limited to the range not in excess of the maximum limited horsepower).

However, to operate the hydraulic pump 2 in the state in which the horsepower control by the pump horsepower control valve 22 is exerted in the entire pressure flow rage region, it is necessary to increase the change amount of the correction value ΔP per unit change amount of the horsepower control pf as indicated by the broken line in FIG. 13. The maximum value of the horsepower control pressure pf, however, is restricted to the delivery pressure p0 of the pilot pump 3 (e.g., 4 MPa), so that it is impossible to make the change in the horsepower control pressure pf with respect to the change in the correction value ΔP sufficiently large. A fixed amount of variation is generated in the horsepower control pressure pf generated by the horsepower control solenoid valve 17 which is a machine element, and variation in the horsepower control pressure pf affects the error in the correction value ΔP.

In view of this, in the present embodiment, the pump horsepower control valve 22, and the like are constructed such that, with respect to the minimum limited horsepower Fmin (FIG. 4) determined by the pump horsepower control valve 22, the pump pressure corresponding the minimum pump flow rate is higher than the minimum pump pressure. In this case, the inclination of the horsepower control pressure pf with respect to the correction value ΔP is increased as indicated by the solid line as compared with the case where the hydraulic pump 2 is operated in the state in which the horsepower control due to the pump horsepower control valve 22 is exerted in the entire pressure flow rate region (broken line). Thus, even when the correction value ΔP is varied by the same amount, it is possible for the change amount of the horsepower control pressure pf to be larger (see X1, X2). This makes it possible to secure a fixed accuracy in the limited horsepower control.

In the present embodiment, in the low pressure and small flow rate region where the pump pressure Pp and the pump flow rate Qp are relatively low, the horsepower control of the pump horsepower control valve 22 ceases to be exerted in the case where the limited horsepower F cannot be reduced to such a degree. It should be noted, however, that load fluctuations due to the actuator operation are likely to be generated in the case where the change in speed and load is large, so that pressure hunting is not easily generated in the low pressure and small flow rate region. Further, when the hydraulic pump 2 operates in the low pressure and small flow rate region, the operation pressure px is low, and the spool opening of the control valve 4 tends to be narrowed, so that the pressure fluctuation attenuation effect due to the throttle of the spool opening is also exerted. Thus, in the low pressure and small flow rate region, there is no problem from the viewpoint of practical use even if the horsepower control of the pump horsepower control valve 22 is not exerted.

[Second Embodiment]

Figure 14:
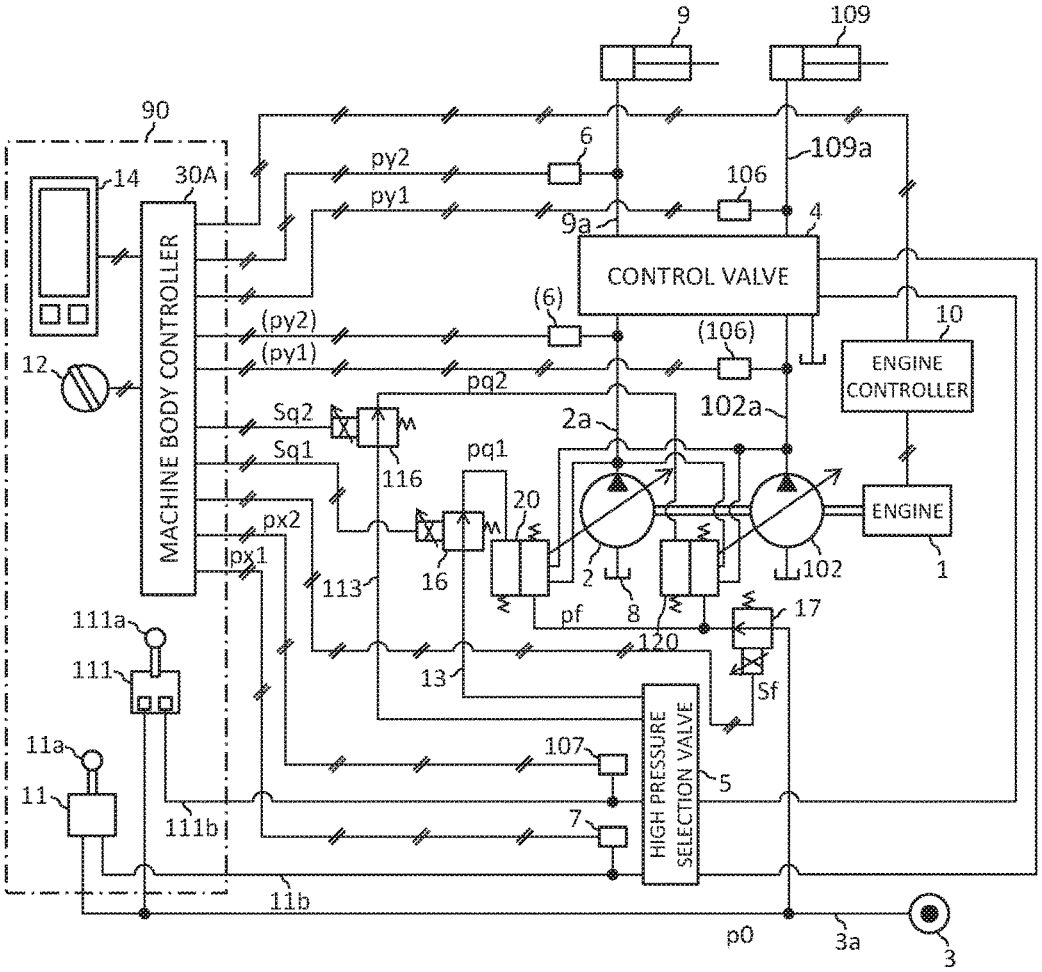
FIG. 14 is a circuit diagram illustrating a main portion of a hydraulic system including a pump control system according to a second embodiment of the present invention.

FIG. 14 is a circuit diagram illustrating a main portion of a hydraulic system including a pump control system according to a second embodiment of the present invention. In FIG. 14, the components that are the same as those of the first embodiment are indicated by the same reference numerals, and a description thereof will be left out. As shown in the drawing, in the present embodiment, the present invention is applied to a hydraulic system in which a plurality of hydraulic pumps 2 and 102 are driven by the same engine 1.

(2-1) Overall Construction

In the present embodiment, there are provided hydraulic pumps 2 and 102, flow rate control solenoid valves 16 and 116, regulators 20 and 120, target horsepower computation sections 41 and 141, and target pump flow rate computation sections 42 and 142. That is, there are provided two sets of each element. In FIG. 14, in the case where there are two corresponding elements through addition to the first embodiment, one is indicated by the reference numeral used in the first embodiment, and the other is indicated by a reference numeral obtained by adding 100 thereto. The hydraulic pump 102 is of the same construction as the hydraulic pump 2, and the hydraulic pumps 2 and 102 are coaxially connected to the common engine 1. The flow rate control solenoid valve 116, the regulator 120, the target horsepower computation section 141, and the target pump flow rate computation section 142 are also of the same construction as the flow rate control solenoid valve 16, the regulator 20, the target horsepower computation section 41, and the target pump flow rate computation section 42. The connection relationship, or the like between these elements are common to the sets and the same as those of the first embodiment, so a detailed description thereof will be left out. On the other hand, there is provided only one horsepower control solenoid valve 17, which is employed commonly to the regulators 20 and 120 (strictly speaking, the pump horsepower control valve 22 thereof).

Further, FIG. 14 shows two operation devices 11 and 111, two hydraulic actuators 9 and 109, two load pressure sensors 6 and 106, and two operation pressure sensors 7 and 107. Regarding the control valve 4 and the high pressure selection valve 5, they are collectively shown as a unit of a plurality of valves. The construction, and the like of each element are as described in connection with the first embodiment, and a detailed description thereof will be left out.

The delivery pressure of the hydraulic pump 2 (hereinafter referred to as the pump pressure Pp1) is guided to the pump horsepower control valve 22 of the regulator 20, and the delivery pressure of the hydraulic pump 102 (hereinafter referred to as the pump pressure Pp2) is guided to the pump horsepower control valve 22 of the regulator 120. In the present embodiment, the upper limit of the total pump flow rate is restricted by the average value of the pump pressures Pp1 and Pp2 (hereinafter referred to as the pump average pressure) such that the total absorption horsepower of the hydraulic pumps 2 and 102 does not exceed a limitation. The horsepower control pressure pf output from one horsepower control solenoid valve 17 is input to the pump horsepower control valve 22 of the regulators 20 and 120, and the total horsepower of the two hydraulic pumps 2 and 102 is controlled by the same horsepower control pressure pf (so-called total horsepower control).

The pump flow rate control valves 23 of the regulators 20 and 120 are driven by flow rate control pressures pq1 and pq2 generated by the flow rate control solenoid valves 16 and 116 respectively using the operation pressures px1 and px2 of the operation devices 11 and 111 as the initial pressures, positively controlling the delivery flow rates of the hydraulic pumps 2 and 102 (hereinafter referred to as the pump flow rates Qp1 and Qp2).

(2-2) Pump Control System

Figure 15:
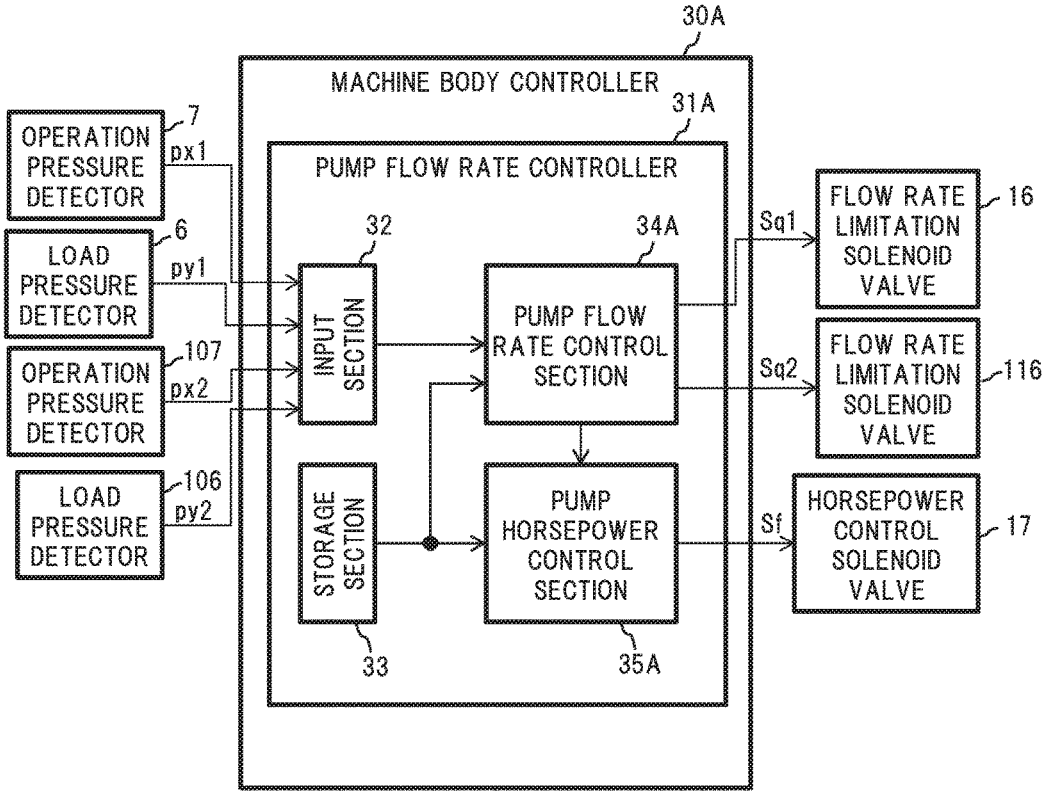
FIG. 15 is a schematic diagram illustrating a machine body controller including a pump controller provided in the pump control system of the second embodiment of the present invention.

FIG. 15 is a schematic view of a machine body controller 30A according to the present embodiment. The machine body controller 30A corresponds to the machine body controller 30 of the first embodiment, and includes a pump controller 31A. The pump controller 31A corresponds to the pump controller 31 of the first embodiment, and is equipped with a pump flow rate control section 34A and a pump horsepower control section 35A. The pump flow rate control section 34A and the pump horsepower control section 35A correspond to the pump flow rate control section 34 and the pump horsepower control section 35 of the first embodiment.

(2-2. 1) Pump Flow Rate Control Section

Figure 16:
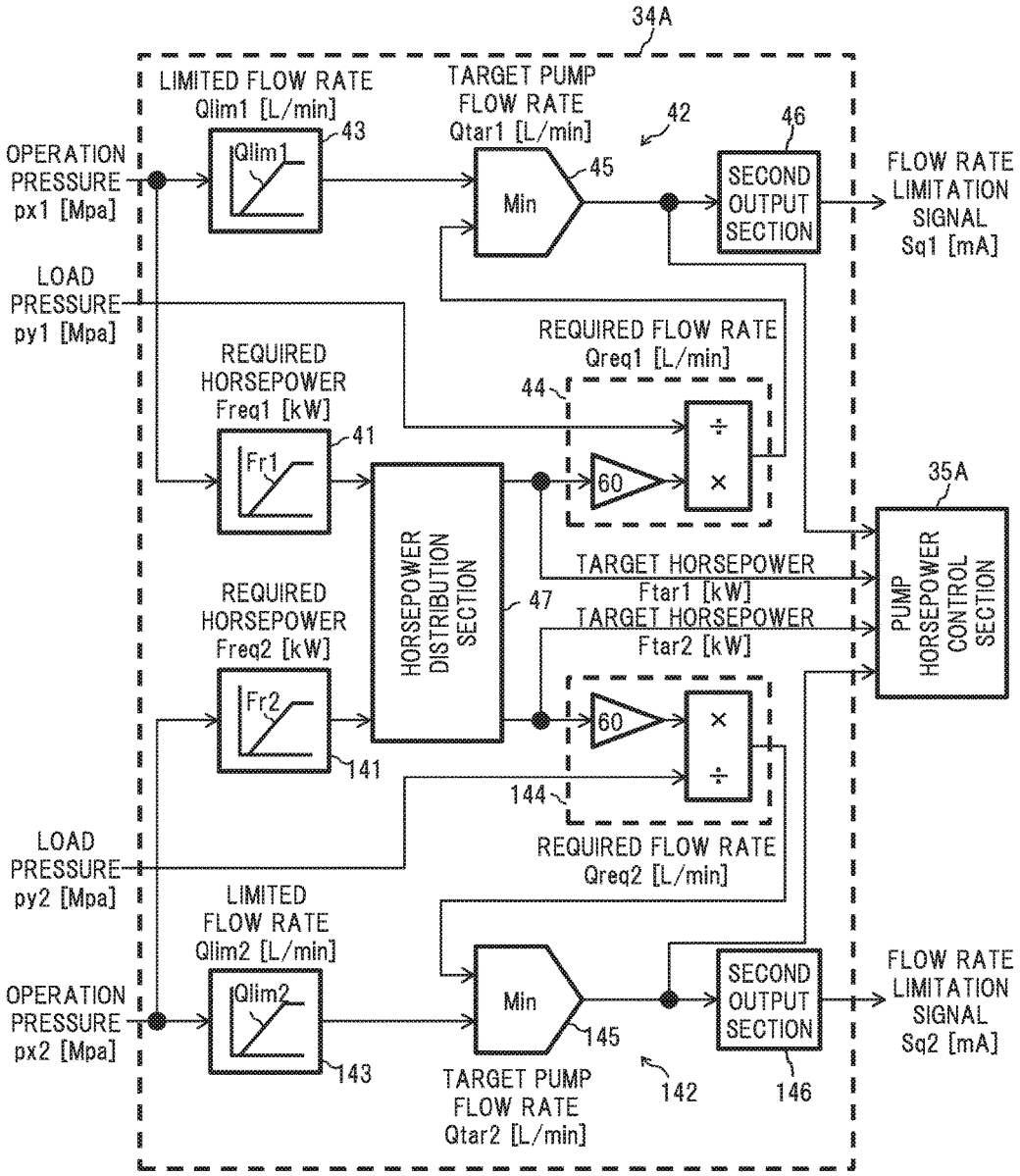
FIG. 16 is a schematic view of a pump flow rate control section provided in the pump control system of the second embodiment of the present invention.

FIG. 16 is a function block diagram illustrating the pump flow rate control section 34A. In the drawing, the components that are the same as those of the first embodiment are indicated by the same reference numerals, and a description thereof will be left out. When there are two elements corresponding to each other, one is indicated by the reference numeral used in the first embodiment and the other is indicated by a reference numeral obtained by adding 100 thereto. The individual construction is the same as that of the first embodiment, so a detailed description thereof will be left out.

Figure 17:
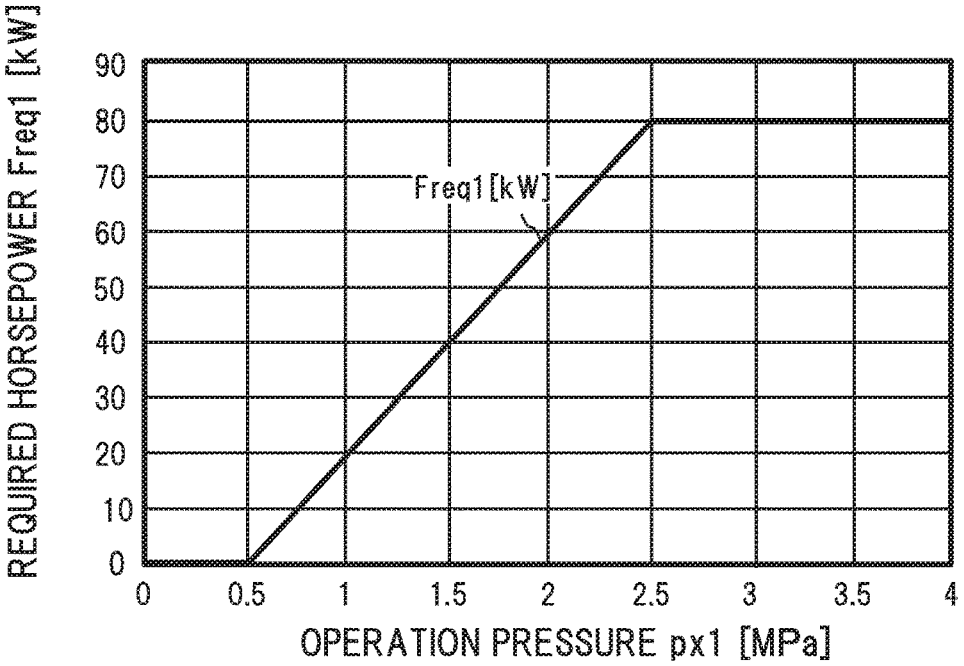
FIG. 17 is a diagram illustrating an example of a control table read by a first target horsepower computation section provided in the pump control system of the second embodiment of the present invention.
Figure 18:
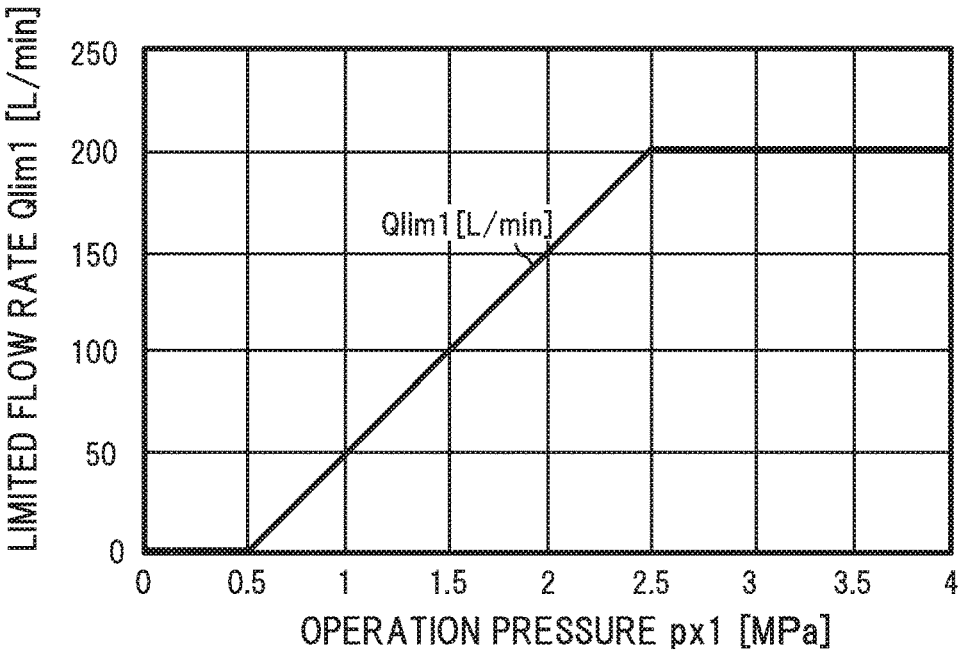
FIG. 18 is a diagram illustrating an example of each control table read by a first limited flow rate computation section provided in the pump control system of the second embodiment of the present invention.
Figure 19:
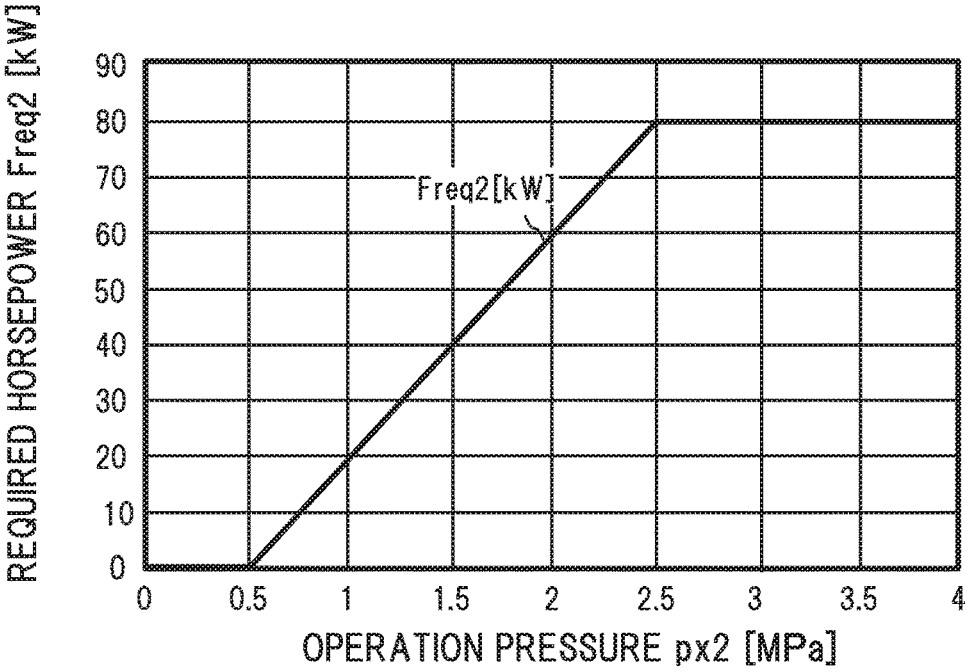
FIG. 19 is a diagram illustrating an example of a control table read by a second target horsepower computation section provided in the pump control system of the second embodiment of the present invention.
Figure 20:
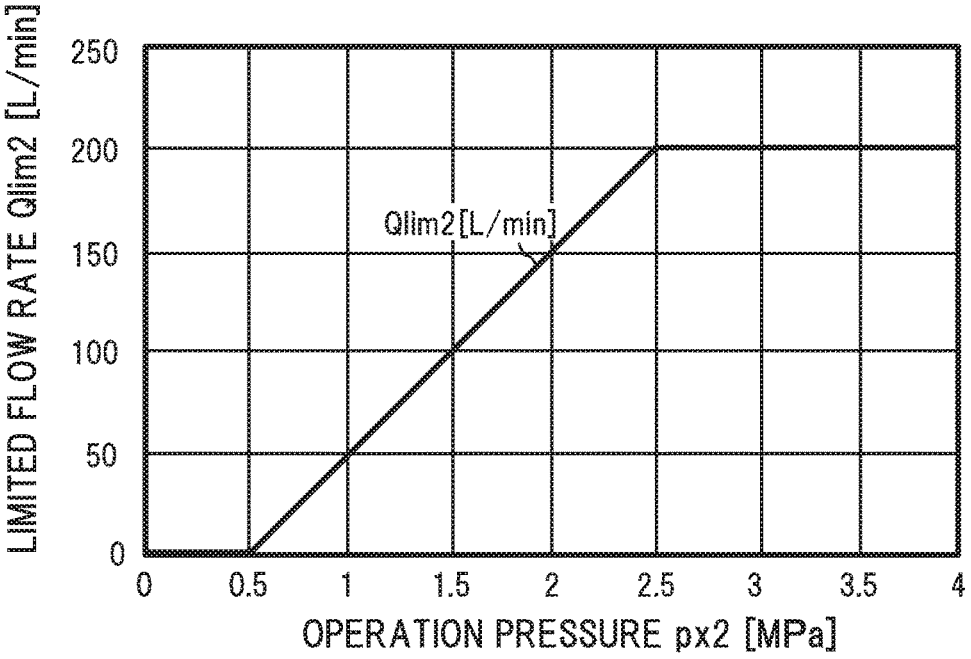
FIG. 20 is a diagram illustrating an example of each control table read by a second limited flow rate computation section provided in the pump control system of the second embodiment of the present invention.

As shown in the drawing, the pump flow rate control section 34A is equipped with target horsepower computation sections 41 and 141, target pump flow rate computation sections 42 and 142, and second output sections 46 and 146. The target horsepower computation sections 41 and 141 are additionally provided with a horsepower distribution section 47. Like the target pump flow rate computation section 42 of the first embodiment, the target pump flow rate computation section 142 is equipped with a limited flow rate computation section 143, a required flow rate computation section 144, and a selection output section 145. FIG. 17 is a diagram illustrating an example of a control table read by the target horsepower computation section 41, and FIG. 18 is a diagram illustrating an example of each control table read by the limited flow rate computation section 43. The drawings correspond to FIGS. 8 and 9. FIG. 19 is a diagram illustrating an example of a control table read by the target horsepower computation section 141, and FIG. 20 is a diagram illustrating an example of each control table read by the limited flow rate computation section 143. The drawings correspond to FIGS. 8 and 9. Also in the present embodiment, these control tables are prepared for each kind of operation and for each combination of the operation devices 11, and are stored in the storage section 33. In the following, a horsepower distribution section 47 will be described.

Horsepower Distribution Section

Figure 21:
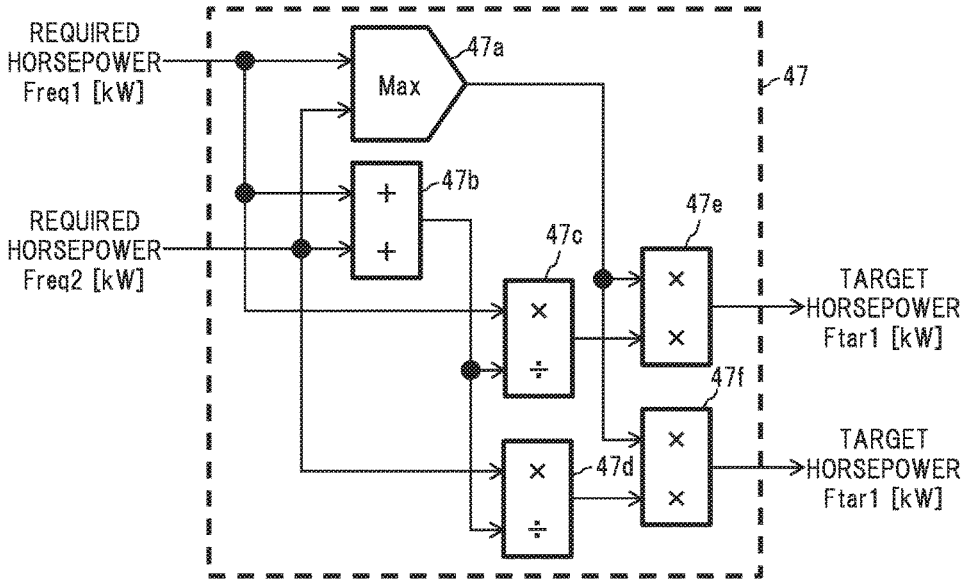
FIG. 21 is a function block diagram illustrating a horsepower distribution section provided in the pump control system of the second embodiment of the present invention.

FIG. 21 is a function block diagram illustrating the horsepower distribution section 47. In the present embodiment, total horsepower control is executed on the two hydraulic pumps 2 and 102, so that it is necessary to distribute the target horsepowers Ftar1 and Ftar2 of the hydraulic pumps 2 and 102, based on the proportion of the required horsepowers Freq1 and Freq2 computed by the target horsepower computation sections 41 and 141. The horsepower distribution section 47 serves to distribute the target horsepower. The horsepower distribution section 47 selects the larger one of the required horsepowers Freq1 and Freq2, and then distributes it through proportional calculation. More specifically, the horsepower distribution section 47 is equipped with a selector 47*a*, an adder 47*b*, dividers 47*c* and 47*d*, and multipliers 47*e* and 47*f*. Assuming that the required horsepower selected by the selector 47*a* is Freq (maximum value of the required horsepowers Freq1 and Freq2), the target horsepowers Ftar1 and Ftar2 are computed by (Equation 3) and (Equation 4).

$$Ftar1=Freq\times\{Freq1/(Freq1+Freq2)\} \quad (3)$$

$$Ftar2=Freq\times\{Freq2/(Freq1+Freq2)\} \quad (4)$$

The computed target horsepowers Ftar1 and Ftar2 are output to the pump horsepower control section 35A. When, for example, a plurality of required horsepowers Freq are simultaneously computed, the required horsepower Freq input to the horsepower distribution section 47 is the sum total thereof. As in the first embodiment, the required horsepower Freq is output to the required flow rate computation sections 44 and 144. At the required flow rate computation sections 44 and 144, the sum total of the required flow rates computed individually from each required horsepower and the corresponding load pressure is computed as the target pump flow rates Qtar1 and Qtar2. As a result, at the target pump flow rate computation sections 42 and 142, the target pump flow rates Qtar1 and Qtar2 are computed from the target horsepowers Ftar1 and Ftar2 distributed by the horsepower distribution section 47. Regarding the other processing of the pump flow rate control section 34A, it is the same as that of the first embodiment.

(2-2. 2) Pump Horsepower Control Section

Figure 22:
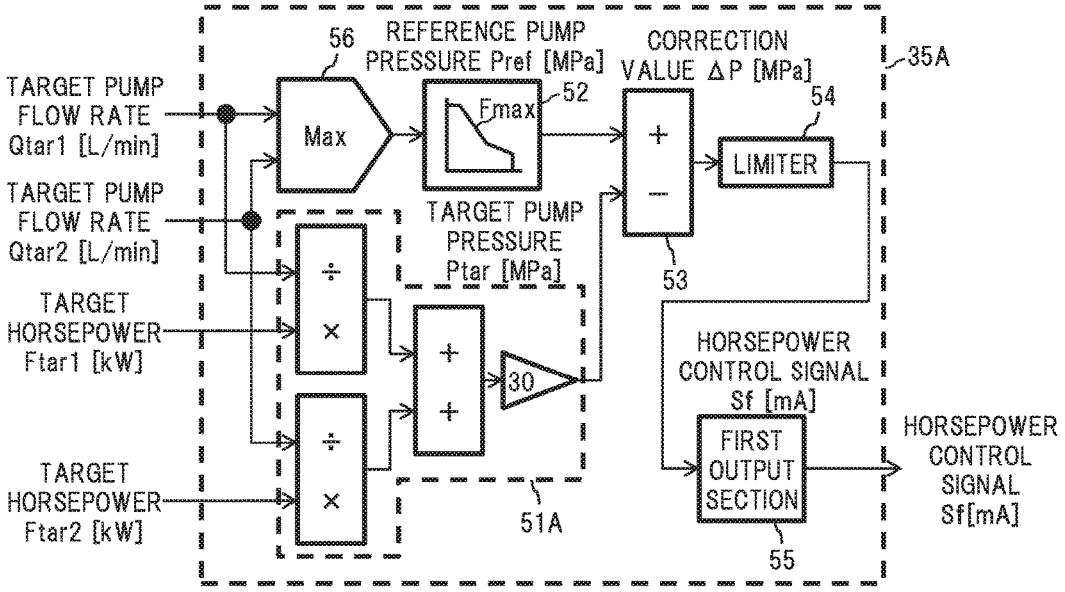
FIG. 22 is a function block diagram illustrating a pump horsepower control section provided in the pump control system of the second embodiment of the present invention.

FIG. 22 is a function block diagram illustrating the pump horsepower control section 35A. In the drawing, the components that are the same as those of the first embodiment are indicated by the same reference numerals, and a description thereof will be left out. The pump horsepower control section 35A is equipped with a selection output section 56, a target pump pressure computation section 51A, a reference pump pressure computation section 52, a correction value computation section 53, a limiter 54, and a first output section 55. The pump horsepower control section 35A differs from the pump horsepower control section 35 of the first embodiment in that the selection output section 56 is added, and that the computation circuit of the target pump pressure computation section 51A is changed. Otherwise, it is the same as the pump horsepower control section 35.

Selection Output Section

The selection output section 56 selects the higher one of the target pump flow rates Qtar1 and Qtar2 input from the pump flow rate control section 34A, and outputs it to the reference pump pressure computation section 52. Thus, at the reference pump pressure computation section 52, there is computed the pump pressure attaining the reference limited horsepower (which, in this example, is the maximum limited horsepower Fmax) at the maximum value of the target pump flow rates Qtar1 and Qtar2 as the reference pump pressure Pref.

Target Pump Pressure Computation Section

At the target pump pressure computation section 51A, the average value of a plurality of pump pressures computed based on a plurality of sets of target pump flow rates and target horsepowers is computed as the target pump pressure, and is output to the correction value computation section 53. More specifically, the average value of the pump pressure P1 obtained from the target horsepower Ftar1 and the target pump flow rate Qtar1 and the pump pressure P2 obtained from the target horsepower Ftar2 and the target pump flow rate Qtar2 is obtained as the target pump pressure Ptar. The following (Equation 5), (Equation 6), and (Equation 7) are employed.

$$P1=(Ftar1/Qtar1)\times 60 \quad (5)$$

$$P2=(Ftar2/Qtar2)\times 60 \quad (6)$$

$$Ptar=(P1+P2)/2 \quad (7)$$

The above equations can be arranged as follows:

$$Ptar=\{(Ftar1/Qtar1)+(Ftar2/Qtar2)\}\times 30 \quad (8)$$

Figure 23:
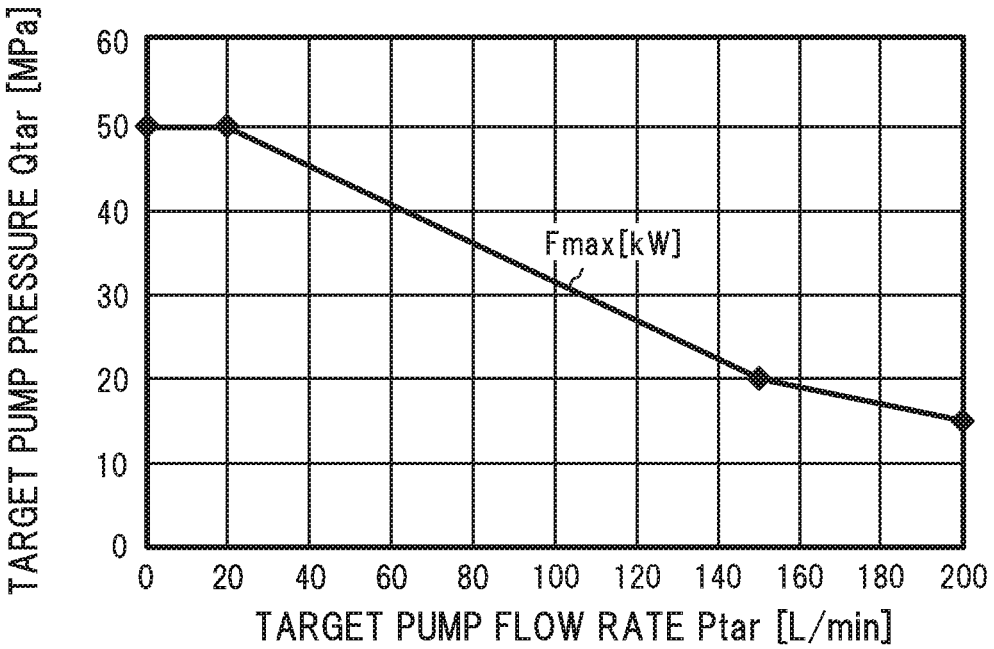
FIG. 23 is a diagram illustrating an example of a control table read by a reference pump pressure computation section provided in the pump control system of the second embodiment of the present invention.

By using the divider, multiplier, or the like as appropriate, the target pump pressure computation section 51A computes the target pump pressure Ptar from (Equation 8). The computed target pump pressure Ptar is output to the correction value computation section 53 and, as in the first embodiment, is subtracted from the reference pump pressure Pref to compute the correction value ΔP. FIG. 23 is a diagram illustrating an example of a control table read by the reference pump pressure computation section 52. The drawing corresponds to FIG. 10. This control table is also stored in the storage section 33. The characteristic shown in FIG. 23 indicates the average pressure with respect to the target pump flow rate Qtar at the time of the maximum limited horsepower (which is the same in the regulators 20 and 120).

(2-3) Operation

The relationship of the target operation points of the hydraulic pumps 2 and 102 is to be represented by the following four cases of A, B, C, and D.

Case A: load pressure py1=py2, and operation pressure px1=px2

Case B: load pressure py1=py2, and operation pressure px1 ≠px2

Case C: load pressure py1≠py2, and operation pressure px1=px2

Case D: load pressure py1≠py2, and operation pressure px1≠px2

The pump operation by the pump control system will be described by using specific values with respect to each of the cases A, B, C, and D.

In the case of Case A

Suppose that the operation pressure px1=4 MPa, that the load pressure py1=15 MPa, that the operation pressure px2=4 MPa, and that the load pressure py2=15 MPa. In this case, from FIGS. 17 through 20, the required horsepower Freq1=80 kW, the limited flow rate Qlim1=200 L/min, the required horsepower Freq2=80 kW, and the limited flow rate Qlim2=200 L/min. In the computation of the horsepower distribution section 47, when the larger value of the required horsepowers Freq1 and Freq2 (which are the same in this case), i.e., 80 kW is distributed in the proportion of the required horsepowers Freq1 and Freq2, the target horsepowers Ftar1 and Ftar2 are obtained as follows:

$$\text{Target horsepower } Ftar1=80\times\{80/(80+80)\}=40 \text{ kW}$$

$$\text{Target horsepower } Ftar2=80\times\{80/(80+80)\}=40 \text{ kW}$$

Further, from the load pressures py1 and py2 and the target horsepowers Ftar1 and Ftar2, the required flow rates Qreq1 and Qreq2 are obtained as follows:

$$\text{Required flow rate } Qreq1=40\times60/15=160 \text{ L/min}$$

$$\text{Required flow rate } Qreq2=40\times60/15=160 \text{ L/min}$$

Since Qreq1<Qref1 and Qreq2<Qref2, the target pump flow rate Qtar1=Qtar2=160 L/min. These are converted to the flow rate control signal Sq, and the flow rate control solenoid valves 16 and 116 are driven. Thus, through the electronic horsepower control of the pump flow rate control section 34A, the hydraulic pump 2 delivers the target pump flow rate Qtar1 with the target horsepower Ftar1, and the hydraulic pump 102 delivers the target pump flow rate Qtar2 with the target horsepower Ftar2.

On the other hand, at the pump horsepower control section 35A, there is computed the target pump pressure Ptar=19 MPa attaining the maximum limited horsepower Fmax with the larger one of the target pump flow rates Qtar1 and Qtar2 (which are the same: 160 L/min). Assuming that both the hydraulic pumps 2 and 102 are driven with the higher one of Qtar1 and Qtar2, Ptar is equal to the pump average pressure attaining the maximum limited horsepower F through total horsepower control.

Further, since Qtarq=Qtar2=160 L/min, and Ftar1=Ftar2=40 kW, the target pump pressure Ptar (pump average pressure) is computed as follows:

$$Ptar=\{(40/160)+(40/160)\}\times30=15 \text{ MPa}$$

Thus, the correction value ΔP=4 MPa This correction value ΔP is converted to the horsepower control signal Sf, and the horsepower control solenoid valve 17 is driven, and hydraulic horsepower control by the pump control valve 22 is just aimed at at the operation point in the electronic horsepower control (15 MPa, and 160 L/min) with respect to the pump of which the target pump flow rate is higher.

Figure 24:
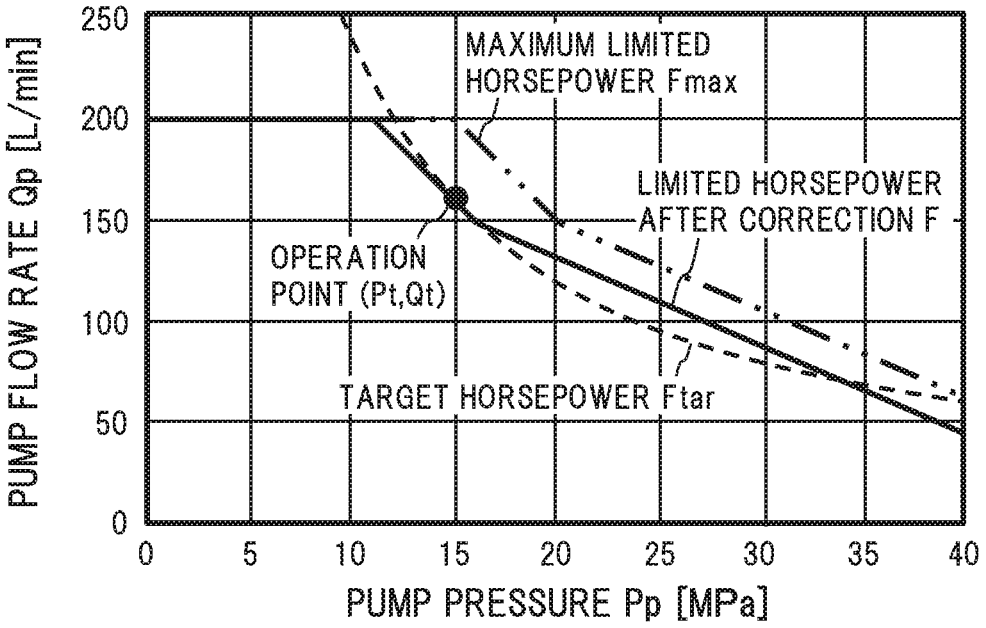
FIG. 24 is an explanatory view illustrating a pump operation in a case A controlled by the pump control system of the second embodiment of the present invention.

FIG. 24 is a diagram illustrating the pump operation in the case of Case A. In the case of Case A, through the control of the pump flow rate control valve 23 by the pump flow rate control section 34A, the pump flow rate are controlled to the target pump flow rates Qtar1 and Qtar2 respectively attaining the target horsepowers Ftar1 and Ftar2 with the load pressures py1 and py2. At the same time, the pump horsepower control valve 22 is controlled such that the limited horsepower is attained at these operation points. In the case of Case A, the operation points, the limited horsepowers and the like are same between the hydraulic pumps 2 and 102 in terms of calculation.

In the Case of Case B

Suppose that the operation pressure px1=2 MPa, that the load pressure py1=20 MPa, that the operation pressure px2=1.5 MPa, and that the load pressure py2=20 MPa.

Limited flow rate Qlim1=150 L/min
Limited flow rate Qlim2=100 L/min
Required horsepower Freq1=60 kW
Required horsepower Freq2=40 kW
Target horsepower Ftar1=36 kW
Target horsepower Ftar2=24 kW
Required flow rate Qreq1=108 L/min
Required flow rate Qreq2=72 L/min
Target pump flow rate Qtar1=108 L/min (=Qreq1)
Target pump flow rate Qtar2=72 L/min (=Qreq2)
Reference pump pressure Pref=29.7 MPa
Target pump pressure Ptar=20 MPa
Correction value ΔP=9.7 MPa
The main values are as mentioned above.

Figure 25:
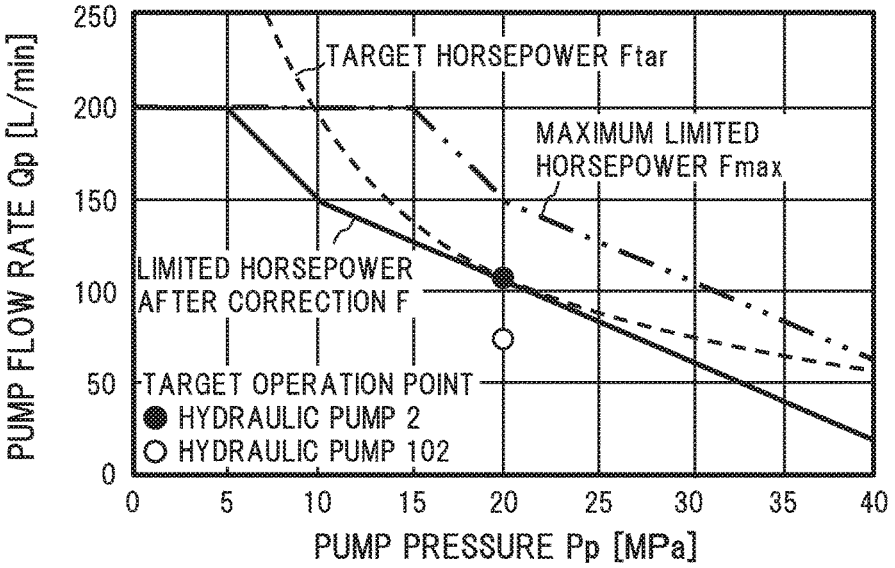
FIG. 25 is an explanatory view illustrating a pump operation in a case B controlled by the pump control system of the second embodiment of the present invention.

FIG. 25 is a diagram illustrating the pump operation in the case of Case B. In the case of Case B, the target pump flow rates Qtar1 and Qtar2 are different between the hydraulic pumps 2 and 102. In this example, with respect to the hydraulic pump of the higher target pump flow rate (the hydraulic pump 2), the limited horsepower F due to the pump horsepower control valve 22 is just aimed at at the operation point due to the electronic horsepower control.

In the Case of Case C

Suppose that the operation pressure px1=2 MPa, that the load pressure py1=25 MPa, that the operation pressure px2=1.4 MPa, and that the load pressure py2=15 MPa.

Limited flow rate Qlim1=150 L/min
Limited flow rate Qlim2=90 L/min
Required horsepower Freq1=60 kW
Required horsepower Freq2=36 kW
Target horsepower Ftar1=37.5 kW
Target horsepower Ftar2=22.5 kW
Required flow rate Qreq1=90 L/min
Required flow rate Qreq2=90 L/min
Target pump flow rate Qtar1=90 L/min (=Qreq1)
Target pump flow rate Qtar2=90 L/min (=Qreq2=Qref2)
Reference pump pressure Pref=33.8 MPa
Target pump pressure Ptar=20 MPa
Correction value ΔP=13.8 MPa
The main values are as mentioned above.

Figure 26:
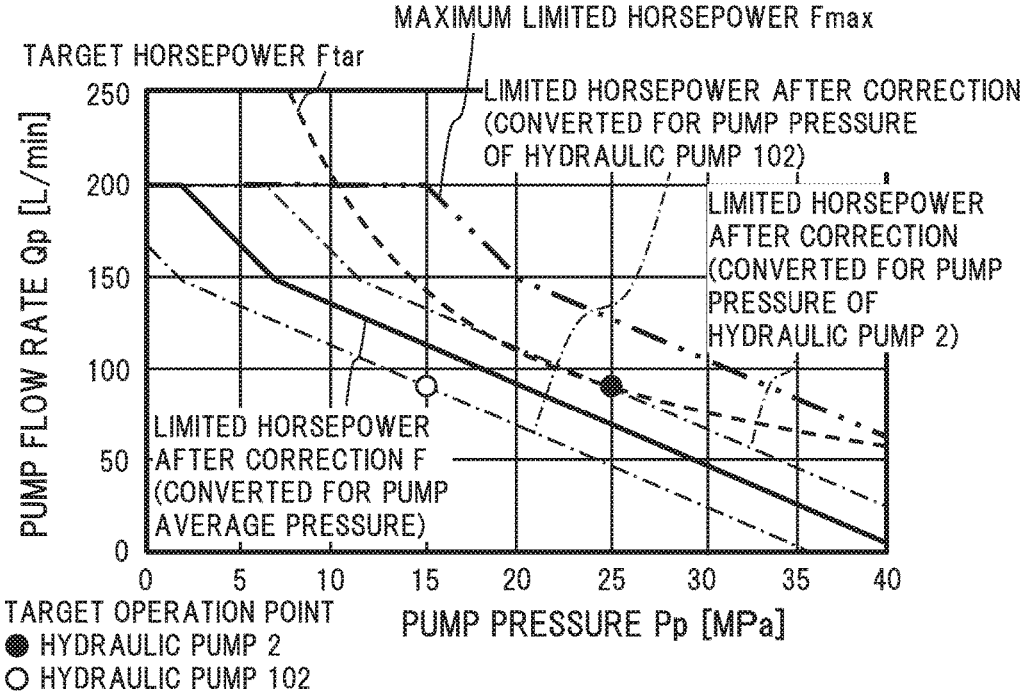
FIG. 26 is an explanatory view illustrating a pump operation in a case C controlled by the pump control system of the second embodiment of the present invention.

FIG. 26 is a diagram illustrating the pump operation in the case of Case C. In the case of Case C, the target pump flow rates Qtar1 and Qtar2 due to the electronic horsepower is the same in the hydraulic pumps 2 and 102. By the pump flow rate control section 34A, the hydraulic pumps 2 and 102 are controlled to the target pump flow rate attaining the target horsepower in accordance with the load pressure. The limited horsepower F is controlled by the pump horsepower control section 35A such that the pump of the higher flow rate (both pumps in this example) is applied to the horsepower control due to the total horsepower control with the target pump flow rate. The limited horsepower of the pump horsepower control valve 22 is just aimed at at the operation point due to the electronic horsepower control of the hydraulic pumps 2 and 102 (25 MPa and 90 L/min in the hydraulic pump 2, and 15 MPa and 90 L/min in the hydraulic pump 102).

In the Case of Case D

Suppose that the operation pressure px1=2 MPa, that the load pressure py1=25 MPa, that the operation pressure px2=1 MPa, and that the load pressure py2=15 MPa.

Limited flow rate Qlim1=150 L/min
Limited flow rate Qlim2=50 L/min

Required horsepower Freq1=60 kW
Required horsepower Freq2=20 kW
Target horsepower Ftar1=45 kW
Target horsepower Ftar2=15 kW
Required flow rate Qreq1=108 L/min
Required flow rate Qreq2=60 L/min
Target pump flow rate Qtar2=108 L/min (=Qreq1)
Target pump flow rate Qtar2=50 L/min (=Qref2)
Reference pump pressure Pref=29.7 MPa
Target pump pressure=21.5 MPa
Correction value ΔP=8.2 MPa
The main values are as mentioned above.

Figure 27:
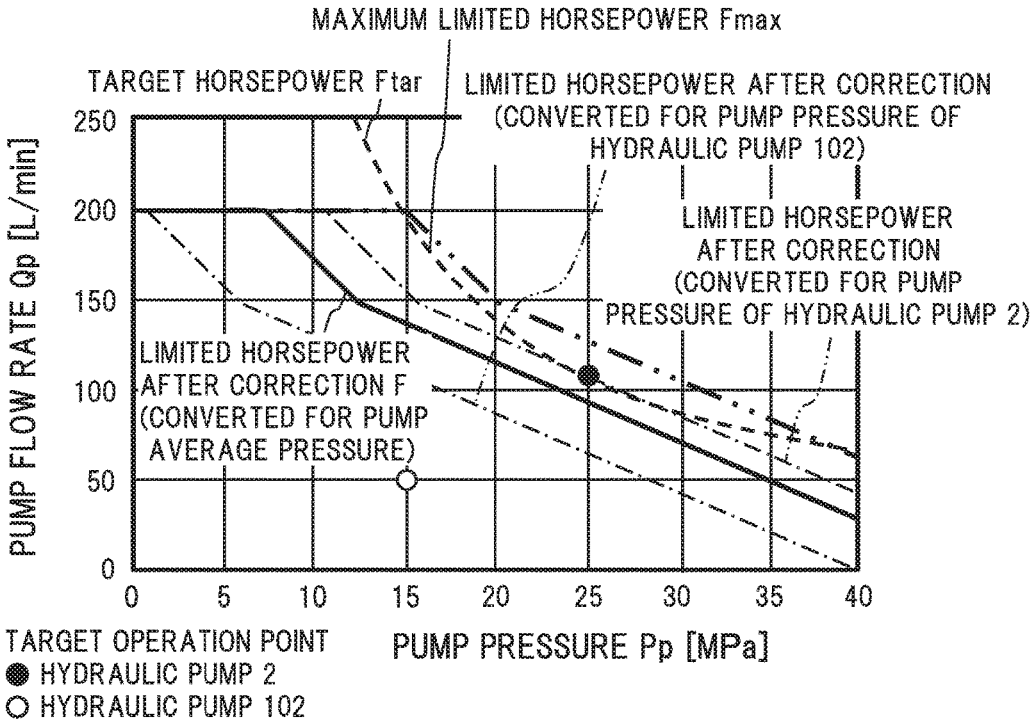
FIG. 27 is an explanatory view illustrating a pump operation in a case D controlled by the pump control system of the second embodiment of the present invention.

FIG. 27 is a diagram illustrating the pump operation in the case of Case D. In this example, the target pump flow rate of the hydraulic pump 2 is higher than that of the hydraulic pump 102, so that the limited horsepower due to the corresponding pump flow rate control valve 22 is aimed at at the operation point of the hydraulic pump 2 (25 MPa and 108

(2-4) Effect

In this way, the present invention is also applicable to a hydraulic system in which a plurality of hydraulic pumps are driven by the same power source. In the present embodiment, the pump horsepower control valves 22 of the hydraulic pumps 2 and 102 share the horsepower control solenoid valve 17, and operation is performed with the limited horsepower with respect to the hydraulic pump of the higher target pump flow rate, whereby it is possible to achieve the same effect as that of the first embodiment with respect to a hydraulic pump subject to pressure hunting. In particular, in the case where the target pump flow rates of a plurality of hydraulic pumps are the same, the effect as that of the first embodiment is achieved at each hydraulic pump. Further, by sharing the pump horsepower control valve 22, it is advantageously possible to suppress an increase in the number of components. The present invention is also applicable in the same manner to a case where the number of hydraulic pumps is three or more, with the effect being the same.

[Modifications]

Omission of the Pump Flow Rate Control Valve

In the example described above, the pump flow rate Qp is negatively controlled via the pump pressure Pp by controlling the limited horsepower F of the pump horsepower control valve 22 in accordance with the operation pressure px while positively controlling the pump flow rate Qp in accordance with the operation pressure px by using the pump flow rate control valve 23. Due to the addition of the pump flow rate control through the control of the pump horsepower control valve 22, it is advantageously possible to shorten the time deviation in the response operation of the hydraulic pumps 2 and 102 with respect to the command of the pump controller 31, 31A.

Here, the operation pressure px is properly output to the control valve 4, whereby the flow rate of the hydraulic fluid supplied to the hydraulic actuator 9 is controlled. As a result, the load pressure py varies, and the pump pressure pp also varies in response thereto. Thus, even if the pump flow rate control valve 23 is omitted in the regulator 20, 120, it is possible to vary the pump flow rate Qp through the utilization of the variation in the pump pressure Pp by controlling the limited horsepower F through the control of the pump horsepower control valve 22. Thus, in so far as the response time of the operation of the hydraulic pump 2, 102 with respect to the command of the pump controller 31, 31A is shortened by using the pump horsepower control valve 22, the pump flow rate control valve 23, the flow rate control solenoid valve 16, 116, and the second output section 46, 146 may be omitted. In this case also, a desired effect is to be expected in terms of the responsiveness in the pump flow rate control.

Change of the Load Pressure Sensor

In the above-described case, the load pressure sensor 6, 106 (actuator pressure sensor) provided in the actuator line 9*a*, 109*a* is used as the sensor for inputting the load pressure py to the pump controller 31, 31A. In this case, the requisite flow rate for operating the hydraulic actuator 9, 109 with the required horsepower assigned in accordance with the operation pressure px is individually evaluated, and the target pump flow rate can be determined based on the same. In many cases, however, the pressure of the actuator line and the pressure of the delivery line of the hydraulic pump are of values akin to each other, and the detection value of the load pressure sensor 6, 106 (pump pressure sensor) provided in the delivery line 2*a*, 102*a* of the hydraulic pump 2, 102 may be input to the pump controller 31, 31A instead. In brief, any pressure sensor can be used as the load pressure sensor 6, 106 so long as it is a sensor detecting the pressure of the line (the delivery line 2*a*, 102*a* or the actuator line 9*a*, 109*a*) connecting the hydraulic pump 2, 102 and the hydraulic actuator 9, 109. For example, in the case where the single sensor detecting the pressure of the delivery line is used as the load pressure sensor 6, the number of sensors used for pump flow rate control is reduced, which contributes to a reduction in the number of components.

Further, instead of using the load pressure py from the load pressure sensor as it is for the control, control may be performed using a value obtained by increasing or decreasing the value of the load pressure py by the setting ratio or the setting amount. For example, by amplifying the load pressure py input from the load pressure sensor 6, the target pump flow rate tends to be computed in a small value. However, the horsepower control of the pump horsepower control valve 22 is more easily exerted, and it is possible to realize a construction in which the pressure hunting suppression effect is regarded as important. For the same purpose, it is possible to adopt a construction in which the correction value ΔP is amplified for correction.

Setting of the Control Table

While in the examples of the control table shown in FIGS. 8 through 10, FIGS. 17 through 20, and FIG. 23 the characteristic of each control table is defined by a straight line (line graph), there are no restrictions regarding the setting of the characteristic. A curve or the like may be used for the setting as needed.

Others

While as the construction for altering the first urging force of the pump horsepower control valve 22 there has been shown by way of example a construction in which the horsepower control pressure pf is exerted from a direction opposite the spring force of the spring 22*s*, the construction of the pump horsepower control valve 22 is not restricted to that of this example. For example, also in a construction in which the spring 22*s* is provided between the wall surface movable in the moving direction of the spool 22*a* and the spool 22*a* and in which the wall surface is moved by the horsepower control pressure pf, it is possible to vary the first urging force with the horsepower control pressure pf. In this case, as the horsepower control pressure pf is reduced, the first urging force is reduced, and the limited horsepower F is reduced.

Further, it is only necessary for the control horsepower serving as a reference for obtaining the correction value ΔP when controlling the limited horsepower F to be a fixed limited horsepower determined as a reference. It is not always necessary for the limited horsepower to be the maximum limited horsepower Fmax. In the case where the value of the correction value ΔP in both the positive and negative directions becomes effective through the setting of the reference limited horsepower, the limiter 54, 154 limiting the correction value ΔP to a value equal to or more than 0 is omitted. Instead, in order that the limited horsepower F may not exceed the maximum limited horsepower Fmax, it is desirable to provide a limiter restricting the magnitude of the correction value in the direction in which the limited horsepower F is increased with respect to the reference limited horsepower.

While in the above-described construction the hydraulic pump 2, 102 is driven by using an engine (e.g., a diesel engine) 1 as the prime mover, the present invention is also applicable to a work machine adopting a motor as the prime mover.

REFERENCE SIGNS LIST

2 . . . Hydraulic pump, 3 . . . Pilot pump, 4 . . . Control valve, 6 . . . Load pressure sensor, 7 . . . Operation pressure sensor, 11 . . . Operation device, 16 . . . Flow rate control solenoid valve, 17 . . . Horsepower control solenoid valve, 22 . . . Pump horsepower control valve, 22*a* . . . Spool, 23 . . . Pump flow rate control valve, 23*a* . . . Spool, 35 . . . Pump horsepower control section, 42 . . . Target pump flow rate computation section, 41 . . . Target horsepower computation section, 43 . . . Limited flow rate computation section, 44 . . . Required flow rate computation section, 45 . . . Selection output section, 47 . . . Horsepower distribution section, 46 . . . Second output section, 51 . . . Target pump pressure computation section, 51A . . . Target pump pressure computation section, 52 . . . Reference pump pressure computation section, 53 . . . Correction value computation section, 55 . . . First output section, 84 . . . Boom (driven member), 85 . . . Arm (driven member), 86 . . . Bucket (driven member), 87 . . . Boom cylinder (hydraulic actuator), 88 . . . Arm cylinder (hydraulic actuator), 89 . . . Bucket cylinder (hydraulic actuator), 91 . . . Crawler (driven member), 92 . . . Traveling motor (hydraulic actuator), 93 . . . Swinging motor (hydraulic actuator), 94 . . . Swing ring (driven member), 102 . . . Hydraulic pump, 106 . . . Load pressure sensor, 107 . . . Operation pressure sensor, 116 . . . Flow rate control solenoid valve, 141 . . . Target horsepower computation section, 142 . . . Target pump flow rate computation section, 143 . . . Limited flow rate computation section, 144 . . . Required flow rate computation section, 145 . . . Selection output section, F . . . Limited horsepower, Fref . . . Reference limited horsepower, Freq . . . Required horsepower, Ftar . . . Target horsepower, px . . . Operation pressure, py . . . Load pressure, Pref . . . Reference pump pressure, Ptar . . . Target pump pressure, Qlim . . . Limited flow rate, Qreq . . . Required flow rate, Qtar . . . Target pump flow rate, ΔP . . . Correction value.

The invention claimed is:

1. A work machine pump control system equipped with at least one actuator driving a driven member, a hydraulic pump that is a variable displacement type and of a bent axis type and that delivers a hydraulic fluid for driving the at least one actuator, at least one control valve controlling the hydraulic fluid to be supplied to a corresponding actuator from the hydraulic pump, at least one pilot operation type operation device generating an operation pressure in accordance with an operation and outputting the operation pressure thus generated to a corresponding control valve, a pilot pump generating an initial pressure of the operation pressure, at least one operation pressure sensor detecting an operation pressure of a corresponding operation device, and at least one load pressure sensor detecting the pressure of a line connecting the hydraulic pump and the at least one actuator as a load pressure, wherein the work machine pump control system comprises:

a pump horsepower control valve that causes a first urging force determining a limited horsepower of the hydraulic pump and a second urging force due to a delivery pressure of the hydraulic pump to act on a spool in opposition to each other and that controls capacity of the hydraulic pump such that a pump absorption horsepower does not exceed the limited horsepower;

a target pump flow rate computation section computing a target pump flow rate of the hydraulic pump on the basis of an operation pressure detected by the at least one operation pressure sensor and a load pressure detected by the load pressure sensor;

a target horsepower computation section that computes a required horsepower corresponding to the detected operation pressure from a relationship related to the operation pressure of a corresponding operation device and that computes a target horsepower based on the required horsepower; and a pump horsepower control section that controls the pump horsepower control valve, based on a target pump flow rate computed by the target pump flow rate computation section and on a target horsepower computed by the target horsepower computation section, such that the target pump flow rate is delivered with the limited horsepower determined by the pump horsepower control valve.

2. The work machine pump control system according to claim 1, further comprising: a horsepower control solenoid valve controlling the first urging force, wherein the pump horsepower control section includes:

a target pump pressure computation section computing a target pump pressure serving as the target pump flow rate with the target horsepower;

a reference pump pressure computation section computing a reference pump pressure corresponding to the target pump flow rate with respect to a reference limited horsepower of the hydraulic pump determined by the pump horsepower control valve;

a correction value computation section subtracting the target pump pressure from the reference pump pressure to compute a correction value of the limited horsepower determined by the first urging force; and a first output section that generates a horsepower control signal in accordance with the correction value and outputs the horsepower control signal thus generated to the horsepower control solenoid valve and that causes the limited horsepower to coincide with the target horsepower.

3. The work machine pump control system according to claim 2, further comprising:

a second output section generating and outputting a flow rate control signal in accordance with the target pump flow rate;

a flow rate control solenoid valve driven by the flow rate control signal to generate a flow rate control pressure; and a pump flow rate control valve driving a spool with an urging force due to the flow rate control pressure to control the capacity of the hydraulic pump.

4. The work machine pump control system according to claim 3, wherein the target pump flow rate computation section includes:

a limited flow rate computation section computing a limited flow rate in accordance with an operation pressure detected by the at least one operation pressure sensor from the relationship related to an operation pressure of a corresponding operation device;

a required flow rate computation section computing a flow rate of the hydraulic pump on the basis of a load pressure detected by the at least one required horsepower sensor and load pressure sensors; and a selection output section selecting a lower one of the limited flow rate and the required flow rate as the target pump flow rate and outputting the lower one thus selected to the target pump pressure computation section, the reference pump pressure computation section, and the second output section.

5. The work machine pump control system according to claim 4, wherein the hydraulic pump, the pump horsepower control valve, the target horsepower computation section, and the target pump flow rate computation section are provided in plural numbers, and the horsepower control solenoid valve is shared by a plurality of the pump horsepower control valves;

there is provided a horsepower distribution section computing a plurality of the target horsepowers based on a ratio of the required horsepower computed by the plurality of target horsepower computation sections and outputting the target horsepowers thus computed to a plurality of the limited flow rate computation sections;

the plurality of target pump flow rate computation sections each computes the target pump flow rate based on target horsepower distributed by the horsepower distribution section;

the reference pump pressure computation section computes a pump pressure that is a maximum value of the plurality of target pump flow rates and that serves as the reference limited horsepower, as the reference pump pressure; and the target pump pressure computation section computes the average value of the plurality of pump pressures computed based on the plurality of target pump flow rates and on the target horsepower, as the target pump pressure, and outputs the target pump pressure thus computed to the correction value computation section.

6. The work machine pump control system according to claim 3, wherein a pump pressure corresponding to a minimum pump flow rate is higher than a minimum pump pressure, with respect to a minimum limited horsepower determined by the pump horsepower control valve.

* * * * *